US011279056B2

(12) United States Patent
Berger et al.

(10) Patent No.: US 11,279,056 B2
(45) Date of Patent: Mar. 22, 2022

(54) DEVICE FOR CARRYING OUT CUTTING OPERATIONS ON OPEN FORMAT EDGES OF A PRINTED PRODUCT

(71) Applicant: Mueller Martini Holding AG, Hergiswil (CH)

(72) Inventors: Christoph Berger, Brugg (CH); Stephan Schmidiger, Dagmersellen (CH); Reto Peyer, Boningen (CH); Thomas Lenhard, Lucerne (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 59 days.

(21) Appl. No.: 16/180,042

(22) Filed: Nov. 5, 2018

(65) Prior Publication Data

US 2019/0134840 A1 May 9, 2019

(30) Foreign Application Priority Data

Nov. 8, 2017 (CH) ..... 01341/17

(51) Int. Cl.
*B26D 7/01* (2006.01)
*B26D 7/02* (2006.01)
(Continued)

(52) U.S. Cl.
CPC ..... *B26D 7/015* (2013.01); *B26D 1/04* (2013.01); *B26D 1/09* (2013.01); *B26D 7/025* (2013.01);
(Continued)

(58) Field of Classification Search
CPC ..... B26D 7/015; B26D 1/09; B26D 7/0675; B26D 7/025; B26D 1/04;
(Continued)

(56) References Cited

U.S. PATENT DOCUMENTS 4,496,140 A * 1/1985 Stobb ..... B26D 1/03 270/52.14
4,518,157 A * 5/1985 Stobb ..... B26D 7/0675 270/52.17
(Continued)

FOREIGN PATENT DOCUMENTS

DE 102011105253 A1 12/2012
EP 1504860 A1 2/2005
(Continued)

*Primary Examiner* — Jonathan G Riley
(74) *Attorney, Agent, or Firm* — Leydig, Voit & Mayer, Ltd.

(57) ABSTRACT

A device for carrying out cutting operations on at least one open format edge of a printed product, includes: a transport unit configured to transfer the printed product along a guide path from a first cutting location to a second cutting location and from the second cutting location to a third cutting location for an edge-related cutting operation, the transport unit having at least one gripper configured to grip the printed product by its spine to convey the printed product from one cutting location to the next in a suspended manner, and at at least one cutting location, at least one cutting tool configured to perform the edge-related cutting operation comprising a first edge-related cutting operation and optionally at least one second subsequent edge-related cutting operation.

46 Claims, 12 Drawing Sheets

(51) Int. Cl.

| | |
|---|---|
| ***B26D 11/00*** | (2006.01) |
| ***B26D 1/04*** | (2006.01) |
| ***B26D 7/06*** | (2006.01) |
| ***B26D 1/09*** | (2006.01) |
| ***B26D 7/00*** | (2006.01) |

(52) U.S. Cl.
CPC ..... *B26D 7/0633* (2013.01); *B26D 7/0675* (2013.01); *B26D 11/00* (2013.01); *B26D 2007/0056* (2013.01); *B26D 2007/0081* (2013.01)

(58) Field of Classification Search
CPC ..... B26D 2007/0081; B26D 7/0633; B26D 11/00; B26D 2007/0056
See application file for complete search history.

(56) References Cited

U.S. PATENT DOCUMENTS

| | | | | |
|---|---|---|---|---|
| 5,209,149 | A * | 5/1993 | Mohr | B26D 7/015 83/157 |
| 5,806,894 | A * | 9/1998 | Dottel | B42F 7/025 281/19.1 |
| 9,828,202 | B2 * | 11/2017 | Meyerhans | B65H 29/003 |
| 10,059,014 | B2 | 8/2018 | Scheid et al. | |
| 10,131,176 | B2 * | 11/2018 | Thurnherr | B42C 11/04 |
| 2002/0018701 | A1 * | 2/2002 | Merkli | B26D 1/09 412/25 |
| 2002/0034428 | A1 * | 3/2002 | Marsh | B26D 1/08 412/16 |
| 2005/0061133 | A1 | 3/2005 | Marbacher | |
| 2005/0066781 | A1 * | 3/2005 | Begemann | B27B 5/04 83/13 |
| 2006/0081100 | A1 | 4/2006 | Fassbind | |
| 2008/0138173 | A1 * | 6/2008 | Brommer | B42C 13/003 412/22 |
| 2016/0311125 | A1 * | 10/2016 | Meyer | B26D 11/00 |

FOREIGN PATENT DOCUMENTS

| | | | |
|---|---|---|---|
| EP | 1647373 | A1 | 4/2006 |
| EP | 3085501 | A1 | 10/2016 |
| JP | 2012218114 | A | 11/2012 |
| JP | 2013183173 | A * | 9/2013 |
| WO | WO 2016168945 | A1 | 10/2016 |

* cited by examiner

DEVICE FOR CARRYING OUT CUTTING OPERATIONS ON OPEN FORMAT EDGES OF A PRINTED PRODUCT

CROSS-REFERENCE TO PRIOR APPLICATIONS

Priority is claimed to Swiss Patent Application No. 01341/2017, filed on Nov. 8, 2017, the entire disclosure of which is hereby incorporated by reference herein.

FIELD

The present invention relates to a device for carrying out cutting operations on open format edges of at least one printed product.

BACKGROUND

To industrially produce printed products, preferably book blocks or booklets, in small or very small print runs, what is known as a three-blade trimmer is used, which is capable of cutting products having the same or variable formats and thicknesses to the desired formats, one after the other with high cycle output and an extremely high cut quality.

The term "open format edges" is understood to include head parts, front parts and foot parts of the printed product, regardless of whether the product is composed of individual pages or signatures.

In three cutting stations, the book blocks or booklets of a predetermined thickness are cut to the final format at the head side, foot side and front side. The book blocks or booklets have a binding on the spine. Any known method may be considered for the binding, for example thread-stitching, perfect binding, gathering-stitching, etc.

The three-blade trimmer is thus intended to be usable as both a solo machine and a machine in a line assembly with other manufacturing machines.

The three-blade trimmers are adapted for cutting the provided printed products, i.e. mostly book blocks and/or booklets, on the three open sides. This is carried out by the book block or the booklet (referred to hereinafter only as book block) being clamped, when stationary, between press bars or press plates and three cutting apparatuses trimming the three aforementioned sides of the book block. The cutting apparatuses may be in the form of counter blade units, in which two blades cut relative to one another like scissors, or as blade units having cutting bars, in which a blade cuts against a fixed plastics bar and slightly penetrates, for protection, the plastics bar when in the final position.

In three-blade trimmers of this type, the head and foot are generally cut in a first phase and the front in a second phase. However, this order is not compulsory and may also be the other way around. It is also possible for only the head and foot or only the front to be cut on the book block, as is required for example for the production of English booklets.

There are three-blade trimmer designs in which the book block remains stationary between the first cutting phase (e.g. head and foot cut) and the second cutting phase (e.g. front cut), and there are designs in which the book block is transported between the cutting phases.

Three-blade trimmers are also known in which, for the cutting, the book blocks are pressed between press rams and cutting cartridges and held in place for the cutting operation (s). When the press ram is raised, the cut book block is transported away and the next book block to be cut is introduced. The book block is moved into position by a centering device and then clamped by the press ram travelling thereunder. The blades move against the book in a swinging cut and cut the open sides. Once all the sides have been cut, the press ram is raised, and the next work cycle may begin. This three-blade trimmer design, however, is not capable of a quick format change. The press ram and also the cutting cartridge are tailored to the format to be processed and may only be replaced by stopping the machine.

DE102011105253 A1 discloses a three-blade trimmer in which the blades cut against cutting bars or counter blades, the book block being held next to the blades by press bars when the head, foot and front are cut. In the gap between the cutting bars or counter blades on the one hand, which gap varies depending on the format, and the space between the press bars on the other, there is arranged a plurality of zigzag support ribs for supporting the book block during the cutting. By means of a three-blade trimmer of this type, good quality cutting may be achieved because the book block is pressed or supported by the press bars and the zigzag support ribs during the cutting.

However, it has to be borne in mind with this solution that the book block may get caught on the zigzag support ribs when being transported into and out of the cutting position. This problem is counteracted in DE102011105253 A1 by the transport system consisting of a lower belt and an upper belt, the two belts for transporting the book block being driven more or less together relative to one another so that the book block cannot get caught on the support ribs of the cutting bed plane or pressing plane. However, when the book block is transported in this way, only one book block may ever be transported in the transport system if the book blocks have different thicknesses. This limits the permissible thickness difference from book block to book block since there is a plurality of book blocks in the transport system. In particular in three-blade trimmers, in which the cutting is carried out in two stations, problems arise when using the described transport system to transport the book blocks that vary greatly in thickness. In the case of book blocks that vary greatly in thickness, it is thus necessary to only transport one book block at a time within the transport system. In such a three-blade trimmer, however, this limits the capacity, i.e. the three-blade trimmer may only be operated with a low number of cycles (low output).

DE102011105253 A1 discloses further three-blade trimmers that define prior art. None of them, however, makes it possible to satisfy the requirements of low changeover time combined with the requirement of high cut quality.

EP1504860 A1 discloses a three-blade trimmer in which the book blocks to be trimmed are gripped by a positioning device and supplied to the cutting apparatuses by a feeding apparatus. A plurality of spaced-apart cutting apparatuses are provided, in which the book blocks are respectively positioned one behind the other by the feeding apparatus for a side cut. In each cutting apparatus, a side cut is carried out on the positioned printed product. The oriented book blocks are moved from the positioning apparatus into a transfer position by an intake gripper by means of a linear stroke, the orientation of the book blocks not being changed. The book blocks are delivered by a multiple epicyclical gearing. To position the book blocks in the cutting apparatuses, adjustable control links are provided. The device allows for simple and quick changeover to different formats. Each cutting apparatus consists of a lower blade fixed to the frame, and an upper blade to which a press plate is coupled by means of a guide and a pneumatic cylinder. Prior to the cutting, the press plate clamps the book block between the press plate and the stationary lower blade. In the process, the book block is not pressed by the press plate, the lower blade and the feeding apparatus over a large surface area, but rather just in the cutting region. The regions of the book block that are not pressed tend to "sag" and may thus lead to an unsatisfactory cut quality. This is the case in particular when soft and/or thin paper is used for the book blocks.

JP 2012-218114 A discloses a three-blade trimmer which may process different book formats one after the other and in which the outer sides of the book are not damaged. A mounting unit for gripping the rear side of the printed product is attached to a moving part, the mounting unit including a reference surface for positioning the spine of the printed product. By means of a positioning actuator, the moving part is moved in a vertical plane by a controller and positioned, respectively in the correct manner for the format, on the three open sides of the printed product for the cutting processes so that the cutting blades moving in the horizontal direction may cut the printed product. The printed product is oriented on the reference surface of the mounting unit and on a vertical bearing surface, which allows the controller, together with the format data, to approach the positions required for each cut and to position the printed product correctly for the cutting.

The disadvantage of this three-blade trimmer is the limited possibility of varying the book format. Since the one mounting unit holds the printed product for all three cuts, the mounting unit has to be significantly smaller than the smallest printed product to be processed. If the printed product has a significantly larger format, the plates that are also used for supporting the printed product during the cutting have to be additionally provided with a large recessed region. However, a large recessed region has a negative effect on the cut quality.

For the front cut, the mounting unit may enter the recessed region of the plates to a greater or lesser extent. The printed product is then only properly supported when the mounting unit is inserted far into the recessed region of the plates. So that the printed product may be sufficiently supported without exchanging the plates, the three-blade trimmer may only be used to process books with a small difference in width.

WO2016/168945 A1 describes a device for carrying out cutting operations on at least one open format edge of at least one printed product, wherein the device is operatively connected to a printed product-related feeding apparatus for the first cutting operation and to a printed product-related removal apparatus which is operative after the last cutting operation. Each edge-related cutting operation is carried out by at least one cutting apparatus. The printed product may be transferred from a first cutting location, in which the cutting operation for a first format edge of the printed product is carried out, to a second location, in which the cutting operation for a second format edge is carried out. The printed product may be transferred to a third cutting location, in which the cutting operation for a third formatting edge is carried out, after the cutting operation at the second cutting location has been carried out. The printed product is transferred from one cutting location to the next by at least one transport unit, wherein the transport unit has at least one means that grips the spine of the printed product and transports the printed product from one cutting location to the next in a suspended manner.

SUMMARY

In an embodiment, a device is provided for carrying out cutting operations on at least one open format edge of at least one printed product, that is operatively connected to a printed product-related feeding apparatus for position-related orientation of the printed product during a first cutting operation and with a printed product-related removal apparatus which operates after a last cutting operation, and which includes: a transport unit configured to transfer the printed product along a guide path from a first cutting location to a second cutting location and from the second cutting location to a third cutting location for an edge-related cutting operation, the transport unit having at least one gripper configured to grip the printed product by its spine to convey the printed product from one cutting location to the next in a suspended manner, and at at least one cutting location, at least one cutting tool configured to perform the edge-related cutting operation comprising a first edge-related cutting operation and optionally at least one second subsequent edge-related cutting operation.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
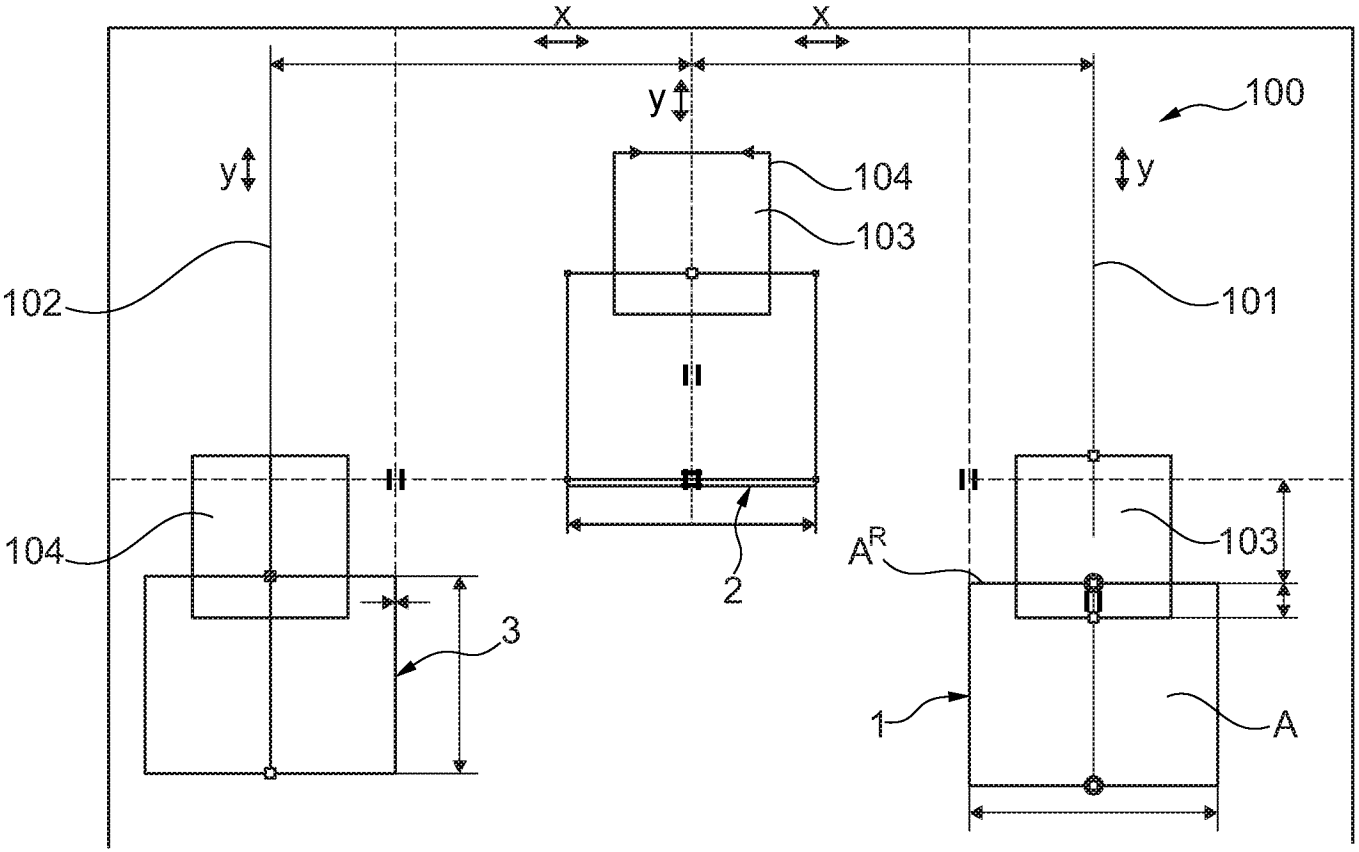
FIG. 1 shows translational movements of supports and grippers within the X-plane and Y-plane.

Embodiments of the present invention provide a device formed as a three-blade trimmer. Embodiments also provide a method for operating a device of this kind formed as a three-blade trimmer. Embodiments of the present invention are able to continuously process printed products of the same or different formats and thicknesses, i.e., by definition, to trim the products to a defined format, while having a high cutting output and cutting quality. The three-blade trimmers according to the invention and the operation thereof are also suitable for the trimming of stacked booklets following the same approach as with a book block.

The three-blade trimmer is thus used for trimming open format edges, also referred to as side edges of printed products, for example books, booklets, magazines, wherein the term "printed product" will be predominantly used hereinafter for the sake of simplicity, with "book block" or "booklet" being used at some points.

By means of the three-blade trimmer according to the invention, the smallest runs may be processed reliably, down to a minimum count of one, without having to plan for machine down-times due to a changeover from one format to the next. In this way, book block formats of various sizes may be supplied to the three-blade trimmer and/or it is possible to process the production of book blocks by means of different portions to be trimmed at the edges.

The object of the invention is achieved by an apparatus in which the printed product is transferred from a first cutting location, at which the cutting operation for a first side edge takes place, to a second cutting location, at which the cutting operation for a second side edge takes place, wherein, once the cutting operation is complete at the second cutting location, the printed product is supplied to a third cutting location, at which the cutting operation for a third side edge takes place, wherein the printed product is transferred from one cutting location to the next by means of at least one transport unit.

To maintain high efficiency of the three-blade trimmer according to the invention, the format changeover takes place while the machine is running, preferably during the period of time that is available for the printed product to be transported in and out.

In the process, the changeover from one format to the next has to take place with high precision so that each cut printed product meets the requirements in terms of its dimensional accuracy.

Since the three-blade trimmer according to the invention may even be used with a print run of just one copy, the aim of the three-blade trimmer according to the invention has to be considered that of reliably cutting the copy provided just once 100% of the time.

Another significant advantage of the invention may be considered to be, that the three-blade trimmer has a simple and functionally reliable design, so it may be operated even by temporary staff.

By means of the three-blade trimmer according to the invention, it is ensured that the dimensional accuracy of the cut printed product and the straight, parallel and rectangular cuts thereof with respect to the front and rear faces of such a printed product are guaranteed.

The three-blade trimmer according to the invention thus ensures high cut quality, even in the case of relatively large printed product thicknesses, since the printed product is clamped to a maximum across its whole surface area between the first and last page by at least one press apparatus while the cutting operations take place at the pending open side edges, and so in this cutting operation it is possible to eliminate the risk of "sags", which are detrimental to quality. The gripping over the entire surface area of the printed product may be achieved as necessary by a plurality of press plates or for example by segmented press plates or individually operable press elements.

In the process, the printed products are supplied to the three-blade trimmer in a horizontal position by means of a conveyor belt, with the bound spine ahead and at an approximately identical distance from one another. The approximately equal distance is either produced by the printed products being supplied to the conveyor belt of the three-blade trimmer in a clocked manner, or a supply of this type is generated by apparatuses and methods known per se upstream of the conveyor belt.

In another embodiment, the printed products are supplied to the conveyor belt of the three-blade trimmer at an irregular distance from one another. A clock apparatus ensures that the distances (spacing between the leading book spine edge and the book spine edge of the following product) do not drop below minimum distances. A sensor detects when the printed product arrives at the conveyor belt of the three-blade trimmer.

As a first preferred variant, if the spacing between the printed products is now greater than the minimum distance, the printed products within the three-blade trimmer process may be completely finished and the feeding may be restarted afterwards. As another option, the speed of the three-blade trimmer may be reduced by the controller and the three-blade trimmer is synchronized with the cycle of the printed product. If the distance exceeds a maximum value, the controller may also optionally generate empty cycles on the three-blade trimmer.

The transport unit consists substantially of at least one support that is equipped on its end with at least one printed product-related gripper, the gripper gripping the book spine of the printed product to be trimmed, whereby the printed product is transported suspended, and the support and gripper forming the basis for the following controller-assisted, translational movements with respect to the cutting locations:

i) Taking the printed product by means of the gripper of the support following the end of the first cutting operation at the first cutting location; ii) Transferring the printed product by means of the same support/gripper to the second cutting location following the cutting operation at the first cutting location; iii) Transferring the same printed product by means of the same support/gripper to the third cutting location for the third cutting operation following the cutting operation at the second cutting location, and then iv) Returning the support/gripper to the starting position at the first cutting location to take a subsequently delivered printed product again once the first cutting operation at the first cutting location has finished.

As a further variant, the transport unit may also consist of two printed product-related supports, which each have a gripper that also grips the book spine of the printed product to be trimmed, wherein the supports having the associated grippers are operatively connected to one another, and the supports and grippers forming the basis for the following controller-assisted, translational movements with respect to the cutting locations:

i) The first gripper of the first support takes the printed product once the first cutting operation is complete at the first cutting location: ii) The first support/gripper transfers the printed product to the second cutting location, where it positions the printed product for the second cutting operation to be carried out, and then travels back to the starting position at the first cutting location, where a subsequently delivered printed product is taken again once the first cutting operation has been carried out thereon at the first cutting location; iii)

In the meantime, the second gripper of the second support takes the printed product immediately after the end of the cutting operation at the second cutting location, and transfers it to the third cutting location, where the third cutting operation takes place; iv) Afterwards, the second support having the second gripper returns to the second cutting location, where an already trimmed printed product provided by the first support/gripper is already standing by to be picked up and transferred to the third cutting location.

During operation with both one support and two supports, generally the head part is trimmed at the first cutting location, the front part is trimmed at the second cutting location and the foot part of the printed product is trimmed at the third cutting location.

A further transport unit for transporting the printed products from one cutting location to the next consists in that at least two, for example three supports run along a substantially stretched rounded, round, or ellipse-like path, wherein this functional endless path consists of a front section and a rear section running substantially in parallel, wherein the two sections transition into one another respectively by a lateral curvature. The front section is used to guide the supports in a straight line or almost in a straight line along the cutting locations. The number of supports along the path is dependent on the maximum permissible cycle, i.e. each support takes a printed product in a spring-guided manner and guides it over the three cutting locations without transfer in the sense of the above description. In order to maximize production, the cycle is designed such that the supports follow one another closely, and the distance from one another is dependent on the time required for the individual cutting operations, whereby more than two, for example three supports are generally used. A reduction of the number of supports may be achieved for example if they experience an acceleration along the rear section between the last and the first cutting operation. With a provision of this kind, the intermediate deliveries and take-overs of a printed product specific to cutting location may thus be implemented by supports moving back and forth. On the other hand, more circulating supports must generally be provided in order to keep production high, and at the same time the infrastructure of the ellipse-like path becomes more demanding.

A transport variant of this kind characterized by an ellipse-like path may form a suitable basis for central trimming of the printed products, that is to say if the three cutting operations are performed at a single cutting location, that is to say if the printed product is taken, fed to the central cutting location, and then delivered by the same support. This support advantageously then does not travel back over the front section, which would inhibit the production flow, but instead performs its return journey over the rear section in order to pick up a new printed product.

If all format edges of the printed product are trimmed at a single central cutting location, the following kinematic sequences should preferably be provided:

As soon as the printed product is positioned properly in a form-fitting manner within a stationary clamping apparatus, it is ultimately fixed by a press assembly, preferably a press beam, against the fixed wall of the clamping apparatus and is thus fixed for the cutting operation. The press beam is preferably arranged at the lower end of a spindle and is connected in terms of drive to a servomotor, which is controlled by a servo drive, via a line. The servo drive is connected via a further signal line to a sensor, which detects the position of the press beam.

By rotating the spindle, the press beam is moved in the direction of the printed product. The servo drive is additionally connected to a superordinate controller. If the printed product has been ultimately fixed, it is then trimmed by a cutting tool, referred to as a blade for short, at the front and then by means of two side blades at the head and foot. The order of the steps may also be reversed: head and foot trimming before front trimming. It is obvious that the movement of the side blades and the associated press beam has to be performed in a phase-shifted manner relative to the movement of the front blade and the associated press beam so as to be able to prevent a collision of the blades. As soon as the cutting by the side blades is complete, the local pressing operations (clamping apparatus, press beam) are thus ended, and the cut printed product is conveyed away.

In the three-blade trimmer according to the invention, this sequence per se is not necessarily set, in particular with regard to the processing order of the first and third cutting location, according to which the head part always has to be trimmed first, but instead it is quite possible to process the foot part at the first cutting location and then the head part at the third cutting location, the front part of the printed product still being trimmed at the second cutting location in order to design the translational movements on which the invention is based in an optimum manner according to the sequence.

Whether the head part or foot part is processed at the first cutting location depends on how the supply of the printed product to the three-blade trimmer is arranged, i.e. whether the front page of the printed product faces up or down on the conveyor belt. In both cases, the spine edge of the printed product remains at the front during transportation to the three-blade trimmer. If a swap of this type (head part/foot part) is carried out, it has to be ensured that corresponding control arrangements are made for the portions to be trimmed off, in particular if head and foot parts having different trimming lengths are to be processed.

The translational movements of the gripper(s) thus cover two or three work planes, specifically:

- a first plane (X) which is characterized by transferring the printed product from one cutting location to the next;
- a second plane (Y) which is characterized by loading and unloading the printed product at the respective cutting locations;
- a third plane (Z) which is characterized by a lateral adjustment (offset movement) of the support/gripper relative to the stationary, printed product-related clamping apparatuses at the cutting location, this lateral adjustment being predefined or optionally being able to be used in a controlled manner.

The gripper itself is equipped on its ends with printed product-related clamping jaws, the gripper or the support(s) having an additional translational degree of freedom in all the aforementioned planes (X, Y, Z) at the cutting locations. In the process, each printed product is gripped to a maximum at its center of gravity, and/or the gripping of the printed product coincides with the best possible geometric location according to the portions to be trimmed off at the open side edges (head, front, foot), it being possible in this latter option to have a moderate to sharp deviation from the theoretical center of gravity of the printed product.

A clamping apparatus is operated in principle in accordance with the following criteria:

a) The clamping jaws associated with a clamping apparatus are directly or indirectly operatively connected to a drive that operates to being about the frictional-connection clamping effect, wherein the clamping jaws guided by the drives include adjustable and/or predictively controlled stroke and frictional-connection profiles geared towards any format shape of the printed product to be processed. The printed product may thus be gripped symmetrically or semi-symmetrically with respect to the center line of the spine of the printed product by the frictional movement profile performed by the clamping jaws. Furthermore, a clamping force may be exerted by means of the clamping jaws at least during the operative phase on the printed product by a mutually coordinated uniform, non-uniform or adaptive speed and/or movement profile.

b) The mutually coordinated uniform, non-uniform or adaptive speed and/or movement profile of both clamping elements of a clamping apparatus may also be provided for one-sided exertion of pressing force by an individual press element. In the sense of a quality assurance of the cutting operation, this concerns the press beam in direct operative connection to the blades, in such a way that the exertion of pressing force thereof on the printed product must be performed in accordance with specific criteria. The speed profile of the press beam may be converted immediately after the first point of contact with the printed product into another mode. This is also true for the further force application on the printed product, which may rise or fall successively in a monotonic or semi-monotonic manner depending on the requirements. Thus, if a certain flexion towards the end of the pressing is desired during the force application, for example so as to act gently on the spine part of the printed product, which if need be is slightly thickened, this may be provided with activation of a corresponding control profile, in accordance with which for example the monotonically rising force application may transition into a curve in accordance with the principle of capacitor charging. Accordingly, it is then readily possible to provide an exponential force application, which is used intermediately or generally.

At each cutting location, the cutting stations of the three-blade trimmer are operatively connected to at least one stationary, semi-stationary or movable force-exerting clamping apparatus that is responsible for the basic gripping and generation of the pressing force on the printed product to be trimmed, the clamping apparatus being tailored to the format size of the printed product, i.e. being able to include an optimized fixed pressing surface, or being able to adjust the surface to the respective format sizes of the printed product during operation by means of simultaneous adaptations.

The force exertion, i.e. the pressing force to be applied, of a clamping apparatus of this type on the printed product during the cutting operation acts on the printed product predominantly, in terms of the forces, counter to the closure force to be exerted by the clamping jaws of the gripper, in such a way that the product remains in a fixed position during the entire cutting operation as a result of the pressing force emanating from the particular clamping apparatus.

Where the closure force of the clamping jaws of the gripper remains at the location of the cutting operation, the pressing force of the clamping apparatus and the vectors thereof do not influence the printed product. This means that, in terms of effect and force, the pressing force of the clamping apparatus is in absolute terms predominant over the closure force of the clamping jaws of the gripper.

At least one clamping apparatus within the three-blade trimmer may consist of two clamping jaws, which perform at least one force-exerting closure movement relative to one another. In addition, at a suitable cutting location, at least one further clamping apparatus may consist of individual interconnected press bars, which exert the pressing force on the press surfaces of the printed product, the press bars together forming a press bar group.

According to the invention, a feeding apparatus (also referred to as a feed wheel or star-shaped wheel owing to its design) is first directly operatively connected to the first cutting operation at the first cutting location. In principle, this feeding apparatus is in the form of a four-part wheel, it also being possible to divide the wheel differently. If a bound book block is to be conveyed, a four-part feeding apparatus of this type operates as follows:

During a first 90° rotation of the feeding apparatus, a hinged rake-like guide is pivoted against the book block in such a manner that, following the 90° rotation, the book block rests on the spine and is protected against fanning out and/or tipping over. The rake-like guide is coupled to a clamping assembly which operates within the feeding apparatus and briefly clamps the book block in a position resting on the spine. The clamping assembly is kinematically designed such that the rake-like guide is transferred into a position dependent on the book block thickness. In this position, the clamping assembly opens slightly, and so the book block orients itself, as a result of gravity, on its spine against a stop surface within the corresponding station of the feeding apparatus. The clamping assembly then closes again, after which the book block is held in a defined position for the additional processes.

Next, the feeding apparatus, i.e. the feed wheel, rotates further by two 90° cycles respectively and moves the book block into a now suspended position. During this rotational movement, the first rake-like guide and an operatively connected second guide are pivoted away from the book block in such a manner that the free sides or signatures of the book block hang vertically downwards as a result of gravity alone, while the book block is held in the region of its spine by the clamping assembly.

The feeding apparatus of the device according to the invention for printed products consisting of two or more booklets may also be formed by a four-part feeding apparatus of this type, this feeding apparatus then operating as follows:

During a first 90° rotation of the feeding apparatus, a hinged rake-like guide is pivoted against the booklets in such a manner that, following the 90° rotation, the booklets rest on their spine and are protected against fanning out and/or tipping over. The rake-like guide is coupled to a clamping assembly that operates within the feeding apparatus and briefly clamps the booklets in a position resting on the spine, the clamping assembly being kinematically designed such that the rake-like guide may be transferred into a position dependent on the thickness. After, the clamping assembly opens again slightly, and so the booklets orient themselves, as a result of gravity, on their spines against a stop surface within the feeding apparatus and/or during this process additional mechanical and/or vibration-triggering means intervene and orient the booklets to form a block having a uniform format. The clamping assembly then closes again, after which the booklets are held in a defined position.

Next, the feeding apparatus rotates further by two 90° cycles respectively and moves the booklets into a now suspended position. During this rotational movement, the first rake-like guide and an operatively connected second guide are pivoted away from the booklets, and so the free sides or signatures of the booklets hang vertically downwards as a result of gravity alone, while the booklets are held by the clamping assembly in the region of their spine.

On the other hand, the feeding apparatus is operatively connected, in the region of the first cutting location, to a movable transport clamp equipped with clamping jaws, which clamp carries out the function of the clamping apparatus and takes the printed product from the feeding apparatus in accordance with the above-described kinematic design and supplies the product to the first cutting operation.

A leveler slide is operatively connected to the feeding apparatus and is intended to be used in addition to the measures explained above to ensure secure positioning of the book block with respect to the stop surfaces thereof.

With both individual books and a stack of booklets, a stop surface is taken as the basis for the orientation, according to the spine side of the printed products, with respect to a fixed bearing surface inside the feeding apparatus. On the other hand, it has to be ensured that, prior to the first cutting operation, the printed products have a corresponding suspended oblong position in the flow direction at the head side and/or the foot side.

In the case of individual books, this takes place in that the individual book is taken, according to the format, from the feeding apparatus by the transport clamping apparatus in a manner controlled by a sensor, on the outer edge of the overhanging cover or of the book block itself in the region of the head part or foot part, respectively. This ensures that the sliver cut off at that point on the book block has a coordinated size.

In the case of a stacked bundle of individual booklets, lateral means that ensure uniform orientation of the cutting-location-side edges of the bundle have to be provided before the first cutting operation.

In summary, the feeding apparatus operates by a hinged, rake-like guide pivoting against the book block so that, following a 90° rotation, the block, now resting on its spine, cannot fan out or tip over. The rake-like guide is coupled to a clamping assembly, which briefly clamps the book block in a position resting on the spine and is kinematically designed such that the rake-like guide may be transferred into a position dependent on the book thickness. Subsequently, the clamping assembly opens again slightly so that the book block or booklets may orient themselves, as a result of gravity, on the book block spine side thereof against the stop surface of the feeding apparatus. The clamping assembly then closes again, after which the book block is held in a defined position.

This approach, which is optimized per se, thus ensures that the spine sides of the printed products assume a defined position that is critical for the subsequent cutting operations.

Nevertheless, for reasons of quality it is appropriate to provide additional measures (leveler slide, active in the vertical and horizontal plane) that are intended to intervene in those cases where it is not sufficient, when the printed products, in particular the book block spines thereof, have different designs, to use gravity alone to guarantee the desired defined position of the book block spine side with respect to the associated stop surface.

In this context, it must be assumed that the printed products, in particular the book blocks, are in most cases configured to have a cover that has a relatively large overhang on all sides (head, foot, front part) with respect to the enclosed body. The overhang in principle does not restrict the cutting process in any way, yet has to be detected by additional sensors during the various cutting operations to ensure precise trimming of the printed product. Owing to logistical aspects, cover sizes that are as identical as possible are advantageously used, whereby a large spectrum of different book block formats may be gripped. It may also be assumed that a relatively large overhang is used in the majority of cases.

To achieve the secure defined position between the book block spine side and stop surface within the feeding apparatus even in the case of covers having a large overhang in the region of the head, foot and front parts, in order for the invention to make a contribution over the prior art it is proposed that, during the brief time the clamping assembly is open to make use of gravity on the printed product, at least one suitable leveler slide is additionally used, which may directly or indirectly exert the necessary contact pressure on the enclosed printed product by means of the cover overhangs so that at least the spine side of the printed product rests securely on the associated stop surface.

For this purpose, the two front cover overhangs of the book block are gripped by a brush comb oriented at an optimum angle in the pressing plane or by other flexible mechanically or pneumatically actuated means, and so the resultant contact pressure is transmitted to the body of the printed product via cover overhangs in such a manner that the product then rests securely on the stop surface arranged within the feeding apparatus.

With the example of a brush comb, the material flexibility thereof is designed in such a way that the resulting free portion of the brush comb between the two cover overhangs may additionally advance as far as to the front part of the book block as a result of the vertical or semi-vertical pressing movement, in order to be able to exert an additional or predominant contact pressure at that point.

In principle, this approach may also be provided in the case of a lateral contact pressure, by suitable means, on the head part or foot part of the printed product to form a uniform plane, and also when the bundle consists of different booklets, so that the uniform edge is then given the optimum position inside the transport clamp apparatus by a sensor.

According to the invention and as mentioned above, the clamping apparatus at the second cutting location consists of press bars that are arranged on both sides of the press surfaces of the printed product and press the printed product simultaneously or one after the other at least from one side.

The number of press bars used during operation on both sides is set and controlled respectively depending on the format size of the printed product to be processed, the press bars put into operation for exerting the pressing force on the printed product also being able to perform movements in opposite directions, either with the same force or by a controlled, gradual force application.

If the press bars act on the printed product one after the other, the pressing effect, i.e. the pressing force application, begins with the first press bar in the region of the spine of the printed product, in order to then proceed continuously almost up to the region of the edge to be cut, by means of a subsequent or semi-subsequent sequence.

Actuating the press bars one after the other along the format of the printed product also means that the air trapped between the pages or signatures of the printed product is also continuously pressed out until a complete thickness consistency of the block is achieved. Only then may the cutting operations, in particular those aimed at the front edge of the printed product, be successfully carried out. This approach may also be carried out in the other cutting operations using corresponding clamping apparatuses.

Regardless of which type of clamping apparatus is used, whether based on clamping jaws or press bars, owing to the use of press beams the printed product is additionally pressed at the ends in the immediate region of the cutting operations, whereby optimum final conditions are achieved for the cutting operation.

In the region of the third cutting operation at the third cutting location, an additional force-exerting clamping apparatus is used, which is constructed according to a four-clamp system, the system also being able to be divided differently. To prevent any linguistic conflicts with respect to the aforementioned clamping apparatuses, a four-clamp system is referred to in the following. The four-clamp system may at the same time, either directly or indirectly, carry out the function of a printed product-related removal apparatus.

After the third cutting operation in direct or indirect operative connection to the removal apparatus, an ejection apparatus is additionally provided, which ensures that produced printed products detected as being defective may be ejected, wherein the ejection may be refined insofar as a distinction is made between printed products that are to be ejected definitively and conditionally.

One variant of this ejection apparatus may be achieved by the technique of using a cross distributor. In order to allow the "good" printed products (books) to pass through, the intervening rollers intended for the ejection are positioned a certain distance beneath a surface formed by longitudinal belts. Provided "good" books are being transported, these rollers remain inactive. If, however, a quality loss of the book is determined by installed sensors, the ejection is activated in a product-specific manner. In such a case, the previously inactive rollers are engaged by being raised for the relevant ejection. These products may be ejected to the left or right depending on whether they are products that are to be ejected definitively or conditionally. In the case of printed products ejected conditionally, it is assumed that they may still be saved. This ejection apparatus is not limited to a cross distributor of this kind.

The four-clamp system of the device according to the invention, which system may receive both book blocks and booklets and may provide the further processing, is operated according to the following criteria:

During the cutting process at the third cutting location, the book blocks or booklets introduced into the four-clamp system for the third cutting operation are pressed between a movable clamping jaw belonging to the four-clamp system and a stationary clamping jaw.

Following the cutting operation at the third cutting location, the rotatable four-clamp system rotates by 90° during each cycle and thus one clamp having the book block or the booklets also moves away from the blade orthogonally to the blade movement at the third cutting location. In this position, the book block or the booklets are conveyed out of the four-clamp system and transferred to a conveyor belt.

In terms of the trimming of the individual open side edges of the printed product, the cutting operations at the cutting locations of the three-blade trimmer are carried out using one individually driven cutting apparatus respectively, at least one cutting apparatus being operated with a single-action cutting blade.

The cutting apparatus is preferably modular and consists of at least three cutting stations for trimming the head, front and foot edge, which cutting stations are U-shaped and arranged with the open side downwards. The cutting operations are thus operatively connected to at least one locally arranged press beam respectively, the press beam acting against the inner planes of the U-shape. By means of this U-shaped configuration, all the cut portions of the book block or booklets fall downwards.

In addition, the three-blade trimmer according to the invention has the following advantages over the known three-blade trimmers:

During the individual cutting operations, the printed product is in clamping apparatuses (clamping jaws or press bar groups) formed at several points, with the additional pressing action from the above-mentioned press beams, and so the printed product is gripped over almost the entire surface thereof during each cutting operation. The printed product is only not gripped in the region of the spine. This is unimportant because the spine binding used respectively (thread-stitching, perfect binding, gathering-stitching, etc.) holds the printed product together sufficiently in this region, while the clamping jaws or press bars used integrally support the printed product to a sufficient extent. This full-surface pressing of the printed product in conjunction with the press beams used are the prerequisites for a high cut quality.

Therefore, the pressing according to the invention over almost the entire surface of the printed product is achieved in an extremely simple manner. There is no need to provide any format-dependent ribs, supporting elements or support bars. As a result, high output with high cycle counts may be achieved in the three-blade trimmer according to the invention.

Since the printed product is transported in a suspended manner to the individual cutting stations of the cutting apparatus by means of the three-blade trimmer according to the invention, there is no need for any supports for the pages of the printed product at the transfer points in the transport system.

Since the printed products are thus not transported horizontally, the pages of the books do not sag between the bearing points if the bearing surfaces are not over the entire surface area, and thus they cannot get caught at the intended transfer points.

The three cutting stations of the cutting apparatus are U-shaped and have the open side of the U directed downwards. The length to be trimmed off at the edges, i.e. at the open sides, of the printed product takes place against the inside of the U-shape in all three cutting operations (head, foot, front part). As a result, one single disposal device may be used, whereby all the accumulating cut-offs may be "conveyed away" together. The cut-offs fall downwards by means of gravity, without any auxiliary means, where they may be collected together or continuously transported away.

Effective removal of cut-offs is therefore very important because, in industrial production of individual printed products (book blocks), the different formats are very often produced first at the three-blade trimmer. In the process, the printed products are supplied to the three-blade trimmer at a size that is tailored to the largest final format, which naturally leads to large portions to be trimmed off in the case of small final formats.

In three-blade trimmers having cutting cartridges and press rams, it is common to orient the printed product from the book spine towards the head side and from the book spine towards the foot side by means of two rectangular stops in the corners, and from the book block front side by one stop. When producing variable-format printed products (book blocks), covers of the same format are often used for a particular format range.

The aforementioned press beam is thus directly operatively connected to the respective cutting blade and ensures that the force imperative for a clean cut is exerted on the printed product.

In principle, two main variants are at the forefront: on the one hand, there is a coupling between the press beam and cutting blade in terms of the forces, i.e. the press beam force consequently has a fixed value, wherein the speed profile (pressing speed/acceleration) then generally also progresses monotonically.

Another variant lies in decoupling the forces exerted by the cutting blade and press beam from one another, such that the press beam then operates in accordance with the following criteria:

A certain force is built up at the press beam as a result of a corresponding torque having been built up at the servomotor by a servo drive. The optimal pressing force on the printed product is determined based on a thickness measurement, which may be implemented easily by means of stored control profiles. A single calibration is generally sufficient for detection of a specific thickness variability of the printed products, provided the underlying pressing force characteristic curve may be considered to be constant because the differences between the book block thicknesses within the same job are relatively small.

By contrast, however, it must be taken into consideration that a significant reduction of the pressing speed and particularly the acceleration must be provided by the optimization of the press stroke, particularly in the case of rigid and/or thin printed products. However, it is advantageous in the case of this concept that the respective cutting apparatuses always operate at the maximum speed, regardless of the production rate, the speed not being limited here by the cutting speed, but instead by the limits determined by the mechanical design. It is additionally essential that with a low machine speed, an extended cycle time is available in particular for operations constituted by transportation, orientation and pressing, since the same amount of time is required for the cutting operation.

If the thickness of the printed products now varies within a certain scope and if these are produced by fixed edge processing, the cover on the uppermost side of the printed product does not protrude to the same extent as on the last page. If the height of the printed product varies, the cover thus protrudes relative to the printed product to a greater or lesser extent on this basis. The printed products are generally produced with a fixed overhang of the cover on one side and a variable overhang on the other side. In the case of products of this kind the orientation of the book block as provided for three-blade trimmers having cutting cartridges and press rams is unsuitable.

By contrast, in the three-blade trimmer according to the invention, the as yet uncut printed product is oriented at the foot or head edge and the spine edge. Therefore, the variable projecting lengths of the width (if need be also height) of the cover of the printed product are insignificant.

A further object of the invention is to control the cutting operation at least at one cutting location such that a plurality of subsequent cutting operations are performed as necessary, that is to say if the format cannot be provided by means of a single cut, and instead, for example for quality reasons, the cutting operations are performed optionally by a plurality of subsequent cuts at the same printed product edge.

For the desired quality results in the case of difficult cutting operations, the controller of the device for carrying out cutting operations is designed such that the operator of the device may himself take control and thus directly introduce the implementation of a subsequent cutting sequence.

Thus, the operator may optionally perform a double or multiple cut ad hoc, or may manage the cutting operations on the basis of stored control profiles, wherein these control profiles may also be implemented adaptively or predictively.

It is obvious that multiple cuts always result in a reduction of the original cycle of the device. On the other hand, however, it is ensured by this provision according to the invention that the cutting procedure may be performed uninterrupted, such that no post-trimming operations need to be provided.

The operative relevant control profiles are retrieved for example on the basis of information predefined by a "marking" in the barcode on the printed product. By means of markings of this kind, instructions are therefore transmitted to the controller regarding the number of cuts to be made at a cutting location. Further stored control profiles may additionally be used in special cases if a switch has to be made to a double cut or multiple cuts on account of a directly determined loss of quality.

In cases in which a single cut does not lead to the sought result, double cuts are usually performed and are used only in the case of extreme edge widths to be trimmed. For the sake of simplicity, reference therefore will be made hereinafter to a double cut, i.e. a first cut (single cut) and a second cut (double cut) if this optional cutting operation, which is extended compared to a single cut, is used.

If, in the present case, reference is made to a double cut, this therefore does not mean that the cutting operation is limited mandatorily to just two cuts. For the sake of simplicity, reference will be made hereinafter to a double cut, but shall thus implicitly also include any subsequent cutting sequence.

The decision as to when a double cut should be performed on a printed product is generally dependent on the overall width of the edge to be trimmed, the total thickness and format of the printed product, the properties of the paper, and the thickness of the cover, etc.

The execution of the double cut is designed such that the second cut tends to be minimized. In any case, a balance must be found between the two cuts, bearing in mind the fact that the formation of crease marks should be avoided wherever possible, such that the loading of the printed product at the spine from the first cut must not be greater than that of the second cut.

The execution of multiple cuts with the device according to the invention means that there are feeding differences depending on whether the subsequent second cut is performed at the head or foot edge or at the front edge of the printed product.

Firstly, it will now be presented how the apparatus-related processes are performed if the head or foot edge are to be trimmed.

Once the first partial cut has been made, the printed product is securely held briefly by the clamping means of the transport unit, whereupon the clamping jaws belonging to a clamping apparatus open slightly, such that the printed product is positioned between the clamping jaws in a pressure-free manner.

Intermediately, the clamping jaws belonging to the transport unit now exert a frictional-connection force on the printed product at the location where the first partial cut was made, thus providing the printed product with an intertemporal local positioning when the clamping jaws of the clamping apparatus are open.

During this interval, the open clamping jaws of the clamping apparatus move backwards or forwards by a certain length corresponding to the width of the second partial cut. The subsequent further advancing movement of the printed product forwards or backwards is based on the locally positioned cutting location in the device, which in the case of the head part preferably acts from the front and in the case of the foot part preferably acts from the rear. Since the cutting locations are arranged in fixed positions, depending on the intake of the printed product it could also be that the forward movement concerns the foot part and the backwards movement concerns the head part of the printed product. The operative further advance of the printed product for the further partial cut is therefore always performed towards the cutting blade.

In both cases, at the end of the travelled length, the clamping jaws of the clamping apparatus exert a frictional-connection force on the printed product again with coordinated opening of the jaws of the transport unit.

These clamping jaws of the clamping apparatus now displace the clamped printed product forwards or backwards by the relevant length for the second partial cut, in such a way that the printed product is transferred again in the cutting position.

Immediately before the second partial cut is started, the printed product is pressed by a cutting location-related press beam, which exerts the ultimate pressing force on the printed product.

Once the second partial cut is complete, the press beam travels back in a manner synchronized with the cutting tool, whereupon the clamping jaws of the clamping apparatus open, and the printed product is then conveyed further on by the transport device, if the cutting location is the first cutting location, or is forwarded via a discharge apparatus, which is arranged downstream of the removal apparatus, if the cutting location is the third cutting location.

With regard to the second cutting location, the method steps are performed as follows for the execution of a second subsequent partial cut of the front part:

Once the first partial cut has been made, the printed product is held briefly by the clamping means of the transport unit, whereupon the clamping jaws or press bars belonging to a clamping apparatus open slightly, such that the printed product is positioned between the clamping jaws or press bars in a pressure-free manner.

Intermediately, the clamping jaws belonging to the transport unit now exert a frictional-connection force on the printed product at the location of the previously made first partial cut, which force provides the printed product with an intertemporal local positioning when the clamping jaws or press bars of the clamping apparatus are open.

During this interval the transport unit moves the printed product downwards in a vertical direction by a certain length, wherein this displacement corresponds to the length of the second partial cut.

At the end of the travelled length, the clamping jaws or press bars of the clamping apparatus exert a frictional-connection force on the printed product with synchronized opening of the clamping jaws belonging to the transport unit.

Immediately before the second partial cut is started, the printed product is pressed by a cutting location-related press beam.

With regard to the force to be exerted on the press beam by a servomotor, this is dependent substantially on the various values of the printed product, and therefore at least book format;

cut-off size;

paper characteristics;

blade sharpness of the cutting tool;

machine speed.

If, for quality reasons, a multiple cut is thus avoided, the main focus should be on exposing the printed product to minimal forces. Since, as mentioned, the ultimate pressing during the cutting operation is exerted by the press beam, it is extremely important that the pressing force preferably produced by an easily adjustable servomotor is separate from the required cutting force of the cutting tool, i.e. the blade. In other words, both assemblies thus operate autonomously.

Once the second partial cut is complete, the press beams move synchronously with the cutting tool back into the starting position, whereupon the clamping jaws or press bars of the clamping apparatus open and the printed product is then conveyed on further by the transport device.

A further variant of the trimming of the open edges of the printed product lies in that the cutting tool is configured to perform the at least second subsequent edge-related cutting operation immediately following the first edge-related cutting operation, and a length of an edge width to be cut based on the head, front or foot portion of the printed product is passed through by a correspondingly guided displacement of the cutting tool to be used there and of a press assembly, relative to the printed product, which is stopped and is securely clamped at the cutting locations. Once the first partial cut has been made, the printed product stops, clamped at the particular cutting location. The cutting tool and the press assembly, interdependently of one another, once the first partial cut is complete at the head or foot edge of the printed product, perform a lateral and, in the case of the front edge, a vertical coordinated displacement corresponding to the length of the respective subsequent, further partial cut. Relevant supports of the transport unit then perform the further transporting of the printed product from one cutting location to the next.

The portions of the printed product to be trimmed which are suitable for a single cut are generally:

head cut: approximately 60 mm;

front cut: up to 125 mm;

foot cut: up to approximately 125 mm.

Accordingly, any larger portions to be trimmed must be processed by a second or further partial cut in order to safeguard the cut quality.

Consequently, the cut-off size when trimming the open edges of the printed product is dependent on the oversizes of the format of the delivered printed product. Proceeding from this starting point, it is then determined whether subsequent partial cuts have to be provided in order to increase the cut quality (cut characteristics).

The quality-assuring examination of the characteristics of the cut is heavily focused towards ensuring that:

a) All open format edges of the printed product have a perfect, smooth cut.

b) The book spines do not have any imperfections caused by pressing, in particular by the press beam, as a result of the cutting process; it must therefore be ensured that the book spines leave the cutting operation and the device itself in perfectly smooth form.

c) The dimensional compliance of the end formats of the printed product are maintained.

d) In particular, the trimming of the head and foot edge is performed strictly within the scope of the predefined cut-off sizes, which ensures perfect layout of the text relative to the edges of the printed product.

The described cutting operations may also be performed by a semi-kinematic reversal of the force/path dynamic, in that the further advance of the printed product for the second partial cut is performed solely by the transport unit. In such a case the clamping jaws of the clamping apparatus remain at the destination and they then perform merely an opening or closing movement based on the closing force, and therefore these clamping jaws no longer perform a movement directed forwards or backwards, forming the basis of the further advance of the printed product by a certain amount. This of course presupposes that the transport unit has corresponding degrees of freedom of movement at least in the X- and Y-direction.

If the required further advance of the printed product relative to the cutting tool (blade) operating at a fixed location is now performed solely by the activation of the transport unit, there is also no forwards or backwards movement of the clamping jaws of the clamping apparatus in the system, and instead the transport unit performs these restrictive movements simultaneously with the printed product gripped in a frictional manner. These movements may therefore be referred to as restrictive because they are partial movements which the transport unit performs from one cutting location to the next.

A further alternative for the second partial cut lies in that, for this partial cut, the following approach is assumed at the head and/or foot part of the printed product: i) Once the first partial cut has been made, the printed product remains in the clamped state at the corresponding cutting location; ii) the cutting tool, i.e. blade, and press beam, once the first partial cut is complete at the head and/or foot part, perform a coordinated lateral displacement corresponding to the length of the second partial cut; iii) the transport unit then further conveys the printed product in accordance with sequences described here. With regard to the trimming of the front part within this scope, a similar approach is assumed, specifically, iv) once the first partial cut has been made, the printed product again remains in the clamped position at the particular cutting location; v) the cutting tool and press beam perform a vertical movement at the front part corresponding to the length of the second partial cut; vi) the transport unit then further conveys the printed product.

For each printed product to be cut, the three-blade trimmer controller has to know product data from which the necessary movements of the transport members may be calculated so that a cut printed product having the desired format dimensions is produced at the end.

In this case, these data may be transmitted to the controller in many different ways. A few options are set out below by way of example:

Each printed product is equipped with an identification feature. A feature reader at the input of the three-blade trimmer reads the identification feature (e.g. 1-D or 2-D barcode, RFID chip, label, image, etc.) and transmits the information from the feature to the controller together with the machine cycle assignment. The feature may contain the necessary pieces of information that depict the cut printed product dimensions, or the missing information may be added from control profiles stored in a database.

In another system, the printed products are supplied to the three-blade trimmer in a clocked manner. With each cycle, the three-blade trimmer controller is supplied with the information that is required for cutting the printed product to the correct dimension. In this case too, data supplied with the printed product may be supplemented with data from a database.

Another option is that the data containing an order of the printed products is communicated to the three-blade trimmer before the printed products are supplied. With each printed product supplied, the three-blade trimmer processes the next dataset in the predetermined order. In the process, the printed products have to be supplied in the correct order. For monitoring purposes, a feature reader that monitors the order may additionally be used.

As mentioned above, the printed products are supplied horizontally to the three-blade trimmer by means of a conveyor belt, with the processed side (processed by thread-stitching, perfect binding, gathering-stitching, etc.) at the front and at an approximately equal distance from one another. The approximately equal distance is either produced by the printed products being supplied to the conveyor belt of the three-blade trimmer in a clocked manner, or it is generated by apparatuses and methods known from the prior art upstream of the conveyor belt.

In another embodiment, the printed products are supplied to the conveyor belt of the three-blade trimmer at an irregular distance from one another. A clock apparatus ensures that the distances (spacing from book spine edge to the book spine edge of the next product) do not drop below minimum distances.

A sensor detects when a book block arrives at the conveyor belt of the three-blade trimmer. As a first preferred variant, if the spacing between the book blocks is now greater than the minimum distance, the printed products within the three-blade trimmer process may be completely finished and the feeding may be restarted afterwards.

As another option, the speed of the three-blade trimmer may be reduced by the controller and the three-blade trimmer may be synchronized with the cycle of the printed product. If the distance exceeds a maximum value, the controller may optionally also generate empty cycles on the three-blade trimmer, as has already been described above in relation to the operation of the feeding apparatus.

Exemplary embodiments of the invention will be described in greater detail below with reference to the drawings. In the following, the printed product is referred to generally as a book block, whereby space is also given to the discussion of other types of printed product, for example booklets.

FIG. 1 is a schematic view of the translational movements of a transport unit belonging to a three-blade trimmer 100, the movements of which unit are performed from two movable, printed product-related supports 101, 102, the supports being operatively interconnected, as will be described in more detail in the description of the other drawings. On their ends, the supports include printed product-related grippers 103, 104 that include clamping jaws and grip one after the other the spine $A^R$ of the printed product A to be trimmed. With respect to the cutting locations 1, 2, 3, which are also referred to as cutting stations, the supports themselves perform the following coordinated, controller-assisted translational movements:

The first support 101 actively takes the printed product A once the first cutting operation at the first cutting location 1 is complete. Then, the first support transfers the printed product A to the second cutting location 2, and returns to the starting position at the first cutting location 1 once the printed product has been deposited in order to pick up another, subsequently delivered printed product A, after the first cutting operation at the first cutting location 1 has been carried out. In the meantime, the second support 102 takes the printed product A immediately after the cutting operation at the second cutting location 2 is complete, and transfers the printed product to the third cutting location 3, where the third cutting operation takes place. Afterwards, the second support 102 returns to the second cutting location 2, where another, already trimmed printed product A provided by the first support is already standing by to be picked up and transferred to the third cutting location 3.

The translational movements of the supports 101, 102 having the connected grippers 103, 104 cover two or three planes, respectively. Specifically in the first plane X the printed product is transferred from one cutting location to the next; in the second plane Y the printed product is loaded and unloaded at the particular cutting location. Optionally, a third plane Z (not shown in greater detail) is also used, in which a lateral adjustment (offset movement) with respect to the stationary printed product-related clamping elements is carried out as required at the particular cutting location of the three-blade trimmer 100.

In the following, the action of the translational movements of the supports will be described on the basis of the grippers since it is these that best depict the operations of the three-blade trimmer.

Figure 2:
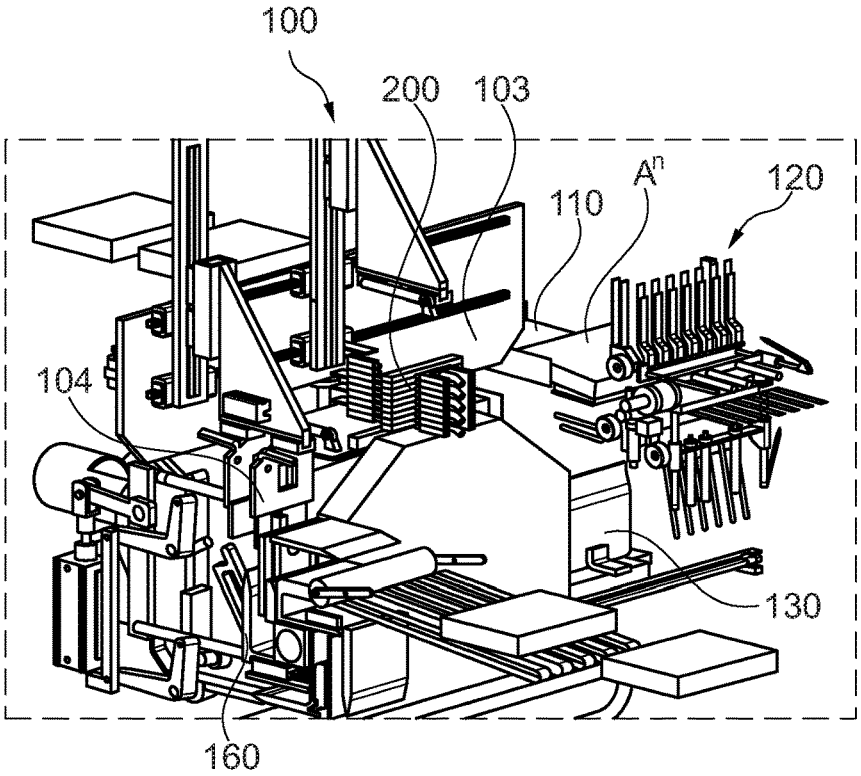
FIG. 2 is an overall view of a three-blade trimmer, showing the supports.
Figure 3:
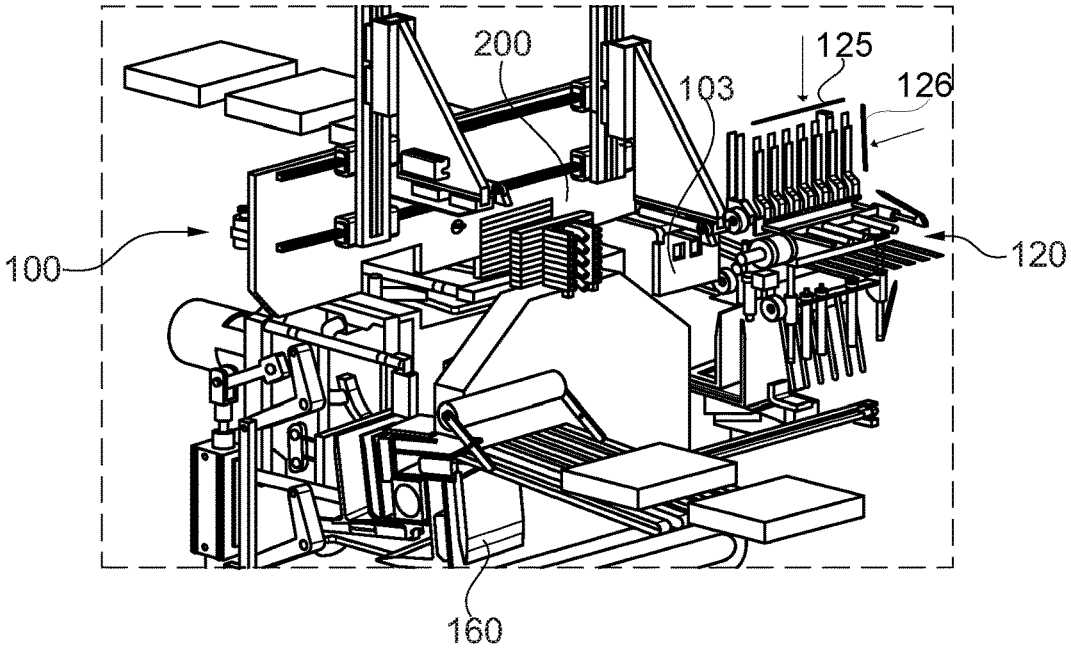
FIG. 3 is an additional view of the three-blade trimmer, showing the supports.

FIGS. 2 and 3 are 3-D views of the three-blade trimmer 100. The book blocks A″ are supplied to the three-blade trimmer 100 in a horizontal position by means of a conveyor belt 110, with the book block spine at the front and at an approximately equal distance from one another. The approximately equal distance is either produced by the book blocks being supplied to the conveyor belt of the three-blade trimmer in a clocked manner, or it is generated by apparatuses known from the prior art upstream of the conveyor belt.

In another embodiment (not shown in greater detail), the book blocks are supplied to the conveyor belt 110 of the three-blade trimmer 100 at an irregular distance from one another. A clock apparatus ensures that the distances (spacing from a leading book spine edge to the book spine edge of the next book block) do not drop below minimum distances.

The moment at which a book block arrives at the conveyor belt of the three-blade trimmer is detected by means of a sensor (not shown in greater detail). If the spacing between the book blocks is now greater than the minimum distance, the speed of the translational movements of the three-blade trimmer is reduced by the controller, after which the three-blade trimmer is synchronized with the cycle of the supplied book block. If the distance exceeds a maximum value, the controller is programmed to be able to generate empty cycles on the three-blade trimmer.

The book blocks A″ are oriented at the head side or foot side by a fixed stop on the conveyor belt 110. This may be implemented by a transport section having slightly skew transport rollers, or by other methods known from the prior art.

The other modules of the three-blade trimmer according to the indications in FIGS. 2 and 3 are described in detail in the following figures.

A leveler slide 125 (see FIGS. 3 and 14) is operatively connected to the feed wheel 120 (feeding apparatus) and is intended to be used in addition to the measures explained above to ensure secure positioning of the book block with respect to the stop surfaces thereof.

With both individual book blocks and a stack of booklets, a stop surface is taken as the basis for the orientation according to the spine side of the printed products with respect to a fixed bearing surface inside the feed wheel 120. On the other hand, it has to be ensured that, prior to the first cutting operation, the printed products have a corresponding suspended oblong position in the flow direction at the head side and/or the foot side.

In the case of book blocks, this is implemented in that the individual book is taken, according to the format, from the feed wheel 120 by the transport clamping apparatus 130 in a manner controlled by a sensor, which operates on the outer edge of the overhanging cover or of the book block itself in the region of the head part or foot part, respectively. This ensures that the edge zone cut off at that point on the book block has a coordinated size.

In the case of a stacked bundle of individual booklets, lateral means that ensure uniform orientation of the cutting-location-side edges of the bundle should preferably be provided before the first cutting operation.

The feed wheel 120 thus operates by a hinged, rake-like guide pivoting against the book block so that, following a 90° rotation, the block, now resting on its spine, cannot fan out or tip over. The rake-like guide is coupled to the clamping assembly, which briefly clamps the book block in a position resting on the spine and is kinematically designed such that the rake-like guide may be transferred into a position dependent on the book thickness. Subsequently, the clamping assembly opens again slightly so that the book block may orient itself, as a result of gravity, on its book block spine side against the stop surface of the feed wheel. The clamping assembly then closes again, after which the book block is held in a defined position.

This approach, which is optimized per se, thus ensures that the spine side of the book block assumes a defined position that is critical for the subsequent cutting operations.

Nevertheless, for reasons of quality it is appropriate to provide additional measures that are intended to intervene in those cases where it is not sufficient, when the book blocks, in particular the book block spines thereof, have different designs, to use gravity components alone to guarantee the desired defined position of the book block spine side with respect to the associated stop surface.

In this context, it must be assumed that the book blocks are in most cases configured to have a cover that has a relatively large overhang on all sides (head, foot, front part) with respect to the original book block body. This overhang in principle does not restrict the cutting process in any way, yet provides logistical advantages owing to standardization since a wide spectrum of different book block formats may be gripped by the same cover size. It may also be assumed that the relatively large overhang is used in the majority of cases.

To achieve the secure defined position between the book block spine side and stop surface within the feed wheel 120 even in the case of covers having a large overhang in the region of the head, foot and front parts, in order for the invention to make a contribution over the prior art it is proposed that, during the brief time the clamping assembly is open to allow for the effect of gravity on the printed product, at least one suitably formed leveler slide 125, 126 (see FIGS. 14 and 15) is used, which may directly or indirectly exert the necessary contact pressure on the book block by means of the cover overhangs so that the book block spine side rests securely on the associated stop surface or is oriented from the side.

For this purpose, the two front cover overhangs of the book block are gripped by brush combs (see FIGS. 14 and 15) oriented at an optimum angle in the pressing plane or by other flexible mechanically or pneumatically actuated means, so the resultant contact pressure is transmitted to the body of the book block A by means of cover overhangs in such a manner that the book block then rests securely on the stop surface arranged within the feed wheel 120, or is otherwise positioned horizontally.

With the example of a brush comb (see FIGS. 14 and 15), the material flexibility thereof is achieved in such a way that the resulting free portion of the brush comb between the two cover overhangs may additionally advance as far as to the front part of the book block as a result of the vertical or semi-vertical pressing movement, in order to be able to exert an additional or predominant contact pressure at that point.

In principle, this contact pressure may also be provided when a lateral contact pressure has to be generally exerted on the head part or foot part of the printed product by suitable means in the form of an additional leveler slide 126 (see FIGS. 3 and 15), with the aim of bringing about the creation of a uniform plane over all the printed products of the bundle so that the edge may then be reliably detected by a sensor so as to be able to produce the optimum position within the transport clamping apparatus 130 to allow the subsequent cutting operations (head and foot) to be carried out to the correct size.

Figure 4:
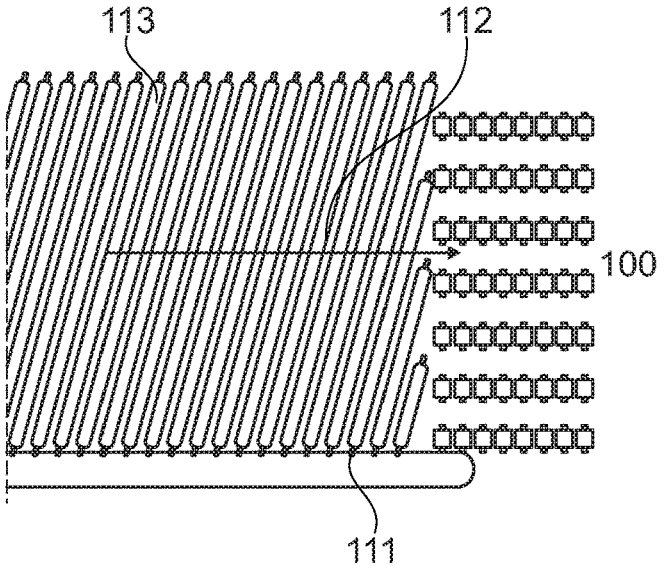
FIG. 4 shows an input apparatus for the book blocks into the three-blade trimmer.

As may be seen from FIG. 4 in this respect, the book blocks are pressed against a fixed stop 111 by transport rollers 113 that are slightly skew in the transport direction 112, and then moved on to the three-blade trimmer 100. The fixed stop 111 may be in the form of a following drive belt (not shown in greater detail) or simply as a fixed plate.

The book blocks A″ then reach a transfer position, from which they are raised for example by a rotating feed wheel 120 and moved into position as a result of rotation.

Figure 5:
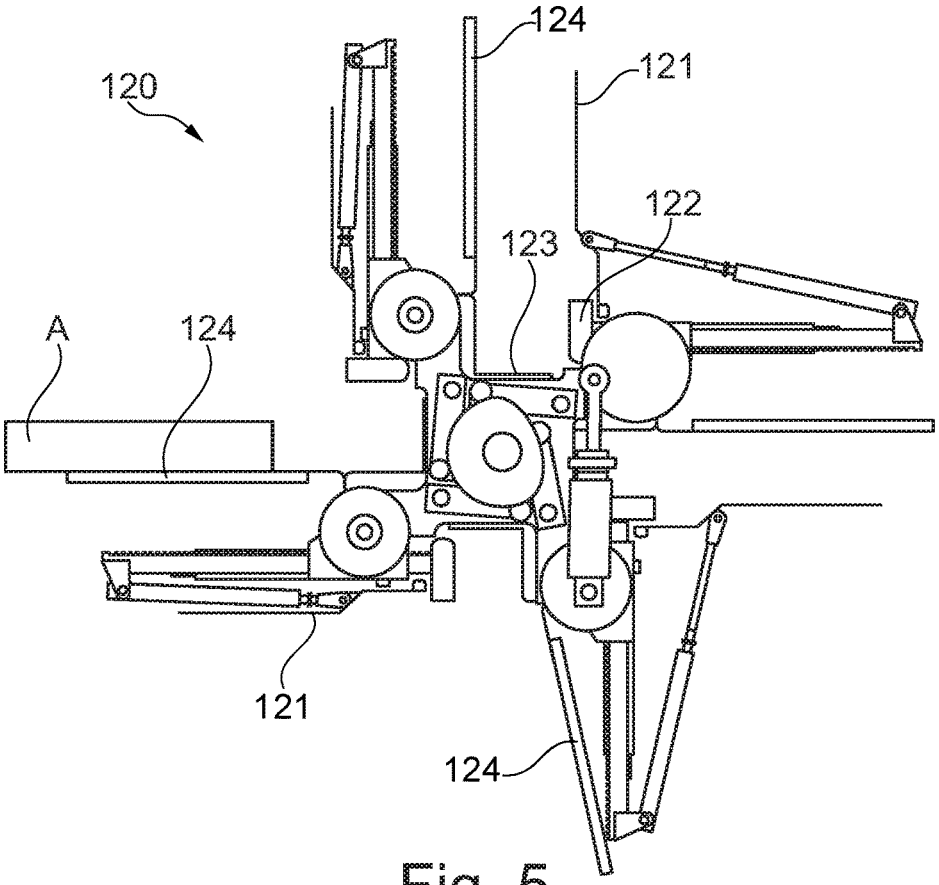
FIG. 5 shows a feed wheel as a feeding apparatus.

As may be seen from FIG. 5 in this respect, during a first 90° rotation of the feed wheel 120 that fulfils the function of a feeding apparatus with respect to a subsequent operation, a hinged rake-like guide 121 pivots against the book block A so that, following the 90° rotation, the book block, now resting on the spine, cannot fan out or tip over. The rake-like guide 121 is coupled to a clamping assembly 122, which briefly clamps the book block in a position resting on the spine and is kinematically designed such that the rake-like guide 121 may be transferred into a position dependent on the book thickness. Subsequently, the clamping assembly 122 opens again slightly so that the book block A may orient itself, as a result of gravity, on its book block spine against the stop surface 123 of the feed wheel 120. The clamping assembly 122 then closes again, after which the book block is firmly held in a defined position. The four-part feed wheel 120 now rotates further by two 90° cycles respectively and generally provides the printed product, in a now suspended position, for the subsequent processing. During this rotational movement, the first rake-like guide 121 and a second rake-like guide 124 operatively connected thereto are pivoted slightly away from the book block so that the pages of the book block hang vertically downwards as a result of gravity alone, while the book block is held on its book block spine by the clamping assembly 122.

In this position, an open transport clamp (easily visible in FIG. 2, reference numeral 130) travels horizontally over the book block towards the book block spine and takes the book block over a large surface area thereof.

Figure 6:
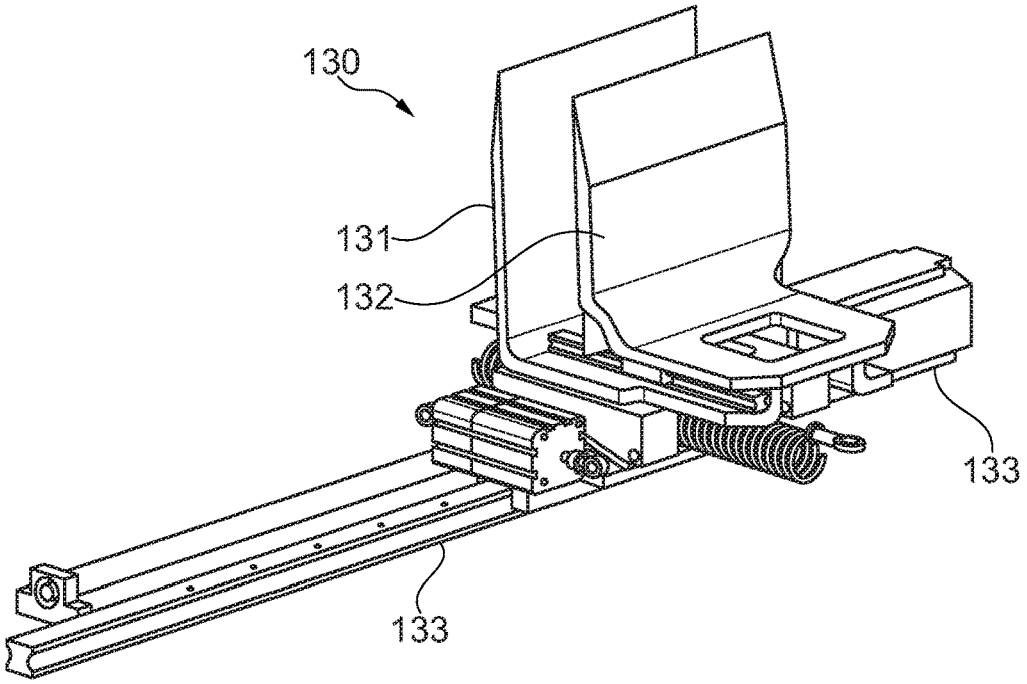
FIG. 6 shows a transport clamp.

As may be seen in this respect in detail from FIG. 6, the transport clamp 130 consists of two clamping jaws 131, 132. Preferably, the transport clamp operates such that one clamping jaw 131 does not perform any stroke while the other clamping jaw 132 carries out the entire stroke. Together, the two clamping jaws 131, 132 cover two different offsets, which depend on whether the printed product is being transported generally or an empty journey is being made.

Optionally, in the case of particular variable and/or inconsistent book block thicknesses, the stroke of the two clamping jaws 131, 132 of the transport clamp 130 may be designed individually, so the same or different paths are covered until the final pressing position is implemented.

The transport clamp 130 may be moved horizontally by a linear movement apparatus 133. A controlled drive (not shown in greater detail) moves the transport clamp 130 precisely with respect to a take-over position in line with the book block. In this case, the take-over position is always dependent on the portion to be trimmed off at the head side or foot side of the book block. When in the take-over position, the transport clamp 130 thus closes and in the process clamps the book block over a large surface area between the front and rear faces thereof. Only the spine region and the region of the book block to be trimmed off are left free respectively. In this regard, reference is made to the description of FIG. 12.

The clamping assembly 122 (see FIG. 5) now opens and releases the book block spine. After that, the transport clamp 130 moves horizontally and transports the book block into the first cutting position (see also FIG. 1, reference numeral 1) of a modular multi-blade apparatus.

The two clamping jaws 131, 132 may also be operated according to the following criteria: Each clamping jaw is directly or indirectly operatively connected to a drive that operates to bring about the frictional-connection clamping effect. The clamping jaws guided by the drives include adjustable and/or predictively controlled stroke and frictional-connection profiles geared towards any format shape of the printed product present, so the frictional gripping of the printed product carried out by the clamping jaws is designed to be symmetrical or semi-symmetrical with respect to the center line of the product. At least during the operative phase for exerting the clamping effect on the printed product, the clamping jaws perform a mutually coordinated uniform, non-uniform or adaptive speed profile. This operation may be provided for all the operatively interconnected clamping jaws that form part of this application.

Figure 7:
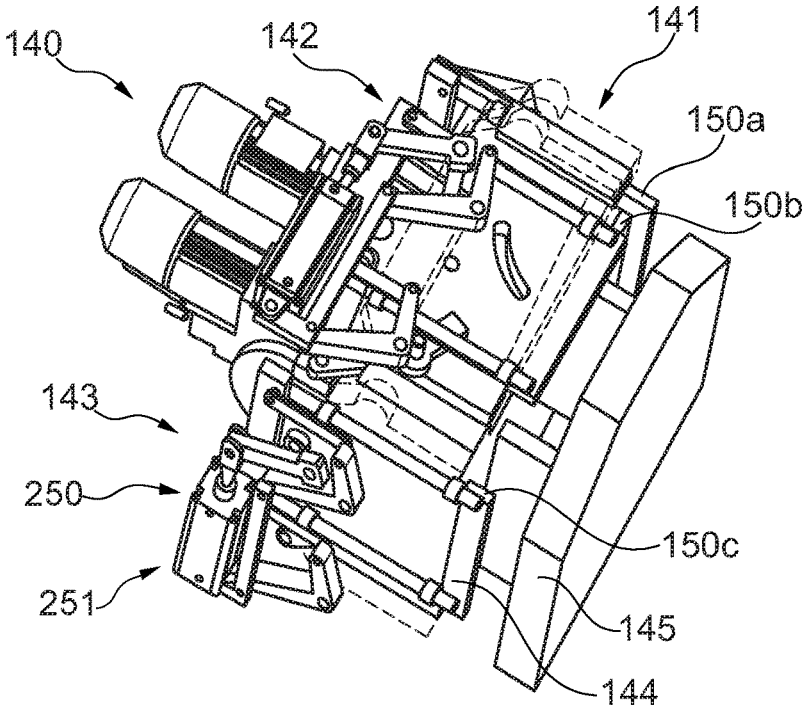
FIG. 7 shows a modular cutting apparatus containing the three cutting stations.

As may be seen in this respect from FIG. 7, the modular cutting apparatus 140 includes three cutting stations, consisting of a first station 141 at the cutting location 1 (see FIG. 1), a second station 142 at the cutting location 2 (see FIG. 1) and a third station 143 at the cutting location 3 (see FIG. 1). For the particular cutting operation, the book block is pressed by a press plate 145 and additionally by a press beam 144 in such a manner that, during the cutting operation, the book block is clamped and pressed to a maximum in the region between the transport clamp and the cutting edge by press beams 144 and the aforementioned press plates, respectively. A blade 150*b* preferably moves in an oblique cut towards a cutting bar, which in itself is stationary.

The respective press beam 144 is thus directly operatively connected to the respective cutting blade 150*a*, 150*b*, 150*c*, and ensures that the force imperative for a clean cut is exerted on the printed product.

In principle, two main variants are the forefront: on the one hand, as symbolized by reference numeral 250 in FIG. 7, there is a coupling between the press beam and cutting blade in terms of the forces, i.e. the press beam force consequently has a fixed value, wherein the speed profile (press speed/acceleration) then generally also progresses monotonically.

Another variant, as symbolized at reference numeral 251 in FIG. 7, lies in decoupling the forces exerted by the cutting blade and press beam from one another, such that the press beam 144 then operates autonomously in accordance with the following criteria:

A certain force is built up at the press beam as a result of a corresponding torque having been built up at the servomotor by a servo drive. The optimal pressing force on the printed product is determined based on a thickness measurement, which may be implemented easily by means of stored control profiles. A single calibration is generally sufficient for detection of a specific thickness variability of the printed products, provided the underlying pressing force characteristic curve may be considered to be constant because the differences between the book block thicknesses within the same job are relatively small By contrast, however, it must be taken into consideration that a significant reduction of the pressing speed and particularly the acceleration must be provided by the optimization of the press stroke, particularly in the case of rigid and/or thin printed products. However, it is advantageous in the case of this concept that the respective cutting apparatuses always operate at the maximum speed, regardless of the production rate, the speed not being limited here by the cutting speed, but instead by the limits determined by the mechanical design. It is additionally essential that with a low machine speed, an extended cycle time is available in particular for operations constituted by transportation, orientation and pressing, since the same amount of time is required for the cutting operation.

The other two cutting locations are worked by the blades 150*a* and 150*c*, which follow substantially the same pressing and cutting philosophy. In the first cutting station 141, the head region of the book block is cut (see also FIG. 1). However, the possibility of starting the first cutting operation with the foot region of the book block is not excluded, although with some configurations this would require an adjustment to the active location of the clamp and, if need be, of the cutting apparatus 140 and the width of the cut-offs, based on the clamping on the book spine side $A^R$ being maintained (see FIG. 1).

Referring back to FIGS. 1, 2 and 3, during the cutting operation in both the vertical (Y-plane, see FIG. 1) and the horizontal direction (X-plane, see FIG. 1), a movable, open first gripper 103 intervenes, the gripper being directed towards the book block spine in the vertical direction. Following the first cut, the first gripper 103 takes the book block by the spine and the transport clamp 130 opens. Subsequently, the transport clamp travels into the take-over position for the next book block. The first gripper 103 transports the book block vertically upwards (Y-plane) from the first cutting operation (FIG. 1, reference numeral 1) and in the process travels through a superimposed, horizontal movement into the second cutting position (FIG. 1, reference numeral 2).

The movement path of the first gripper 103 in the vertical direction is controlled by the machine controller according to the width of the cut book block, it also being possible for the movement path of the gripper to be independently controlled in general in the horizontal direction with respect to the book block, for instance when a specific gripping position is desired. For example, when the format and the portions to be trimmed off in each book block necessitate an asymmetrical or semi-asymmetrical clamping effect or a one-sided clamping effect dependent on the center of gravity.

In the second cutting position (FIG. 1, reference numeral 2), the book block is clamped by a plurality of press bars, which belong to a press bar group (FIGS. 2 and 3, reference numeral 200), by means of which bars the book blocks are clamped between the front page and the back page. In FIG. 2, the press bar group is shown in the closed state, while the press bar group in FIG. 3 is shown in an open state.

Figure 8:
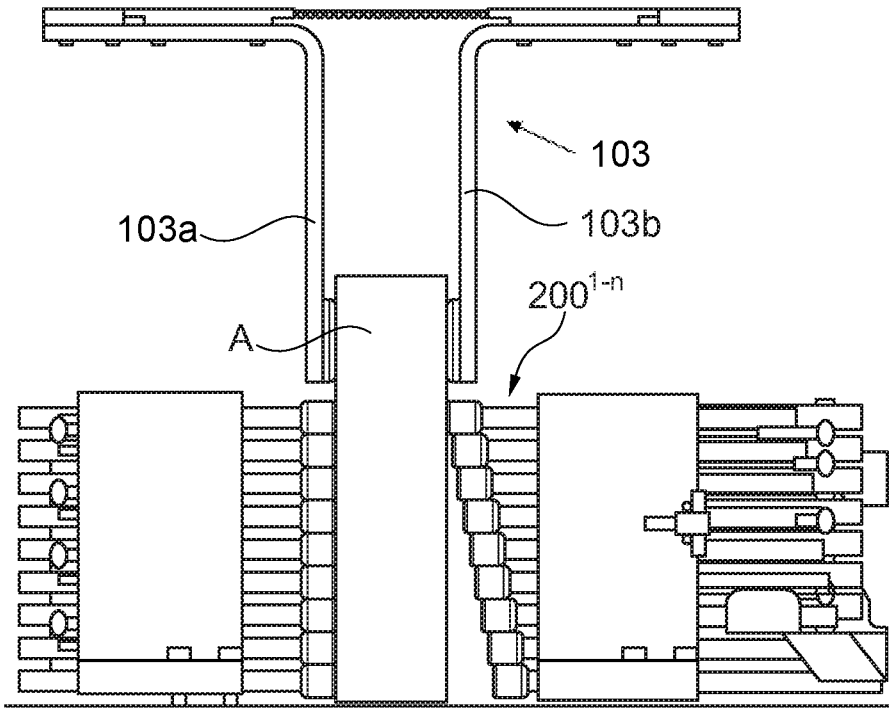
FIG. 8 is an illustration during operation of the press bars.
Figure 9:
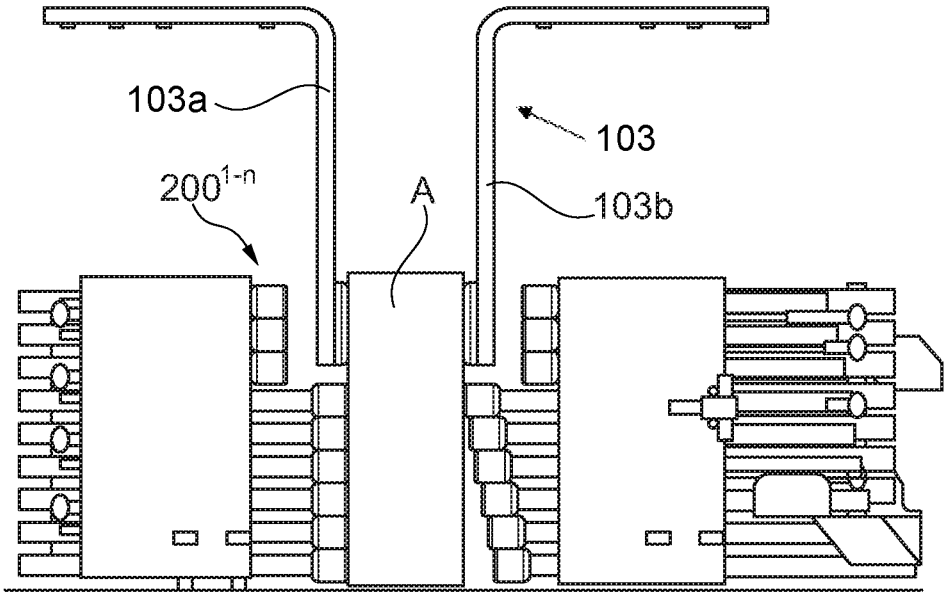
FIG. 9 is an additional illustration during operation of the press bars.

As may be seen in FIGS. 8 and 9, the individual press bars $\mathbf{200}^{1\text{-}n}$ close one after the other, starting from the book spine, so that the air between the individual sheets may be pressed out in a targeted manner towards the cut edge, which also smooths the printed product as a whole at the same time. As may then be seen clearly from FIG. 9, the number of press bars that close is only ever the number for which there is space between the position of the gripper 103 having the respective clamping jaws 103*a*, 103*b*, and the second cutting station 142 at the second cutting location 2 (see FIG. 1). The same clamping jaws 104*a* and 104*b* (not shown in greater detail) are associated with the other gripper 104 (see FIG. 1). Therefore, the book block is again pressed over a large surface area. In the second cutting station 142, the front side of the book block is now cut, similarly to the manner in the first and third cutting stations 141, 143 for the head and foot side, respectively.

Figure 10:
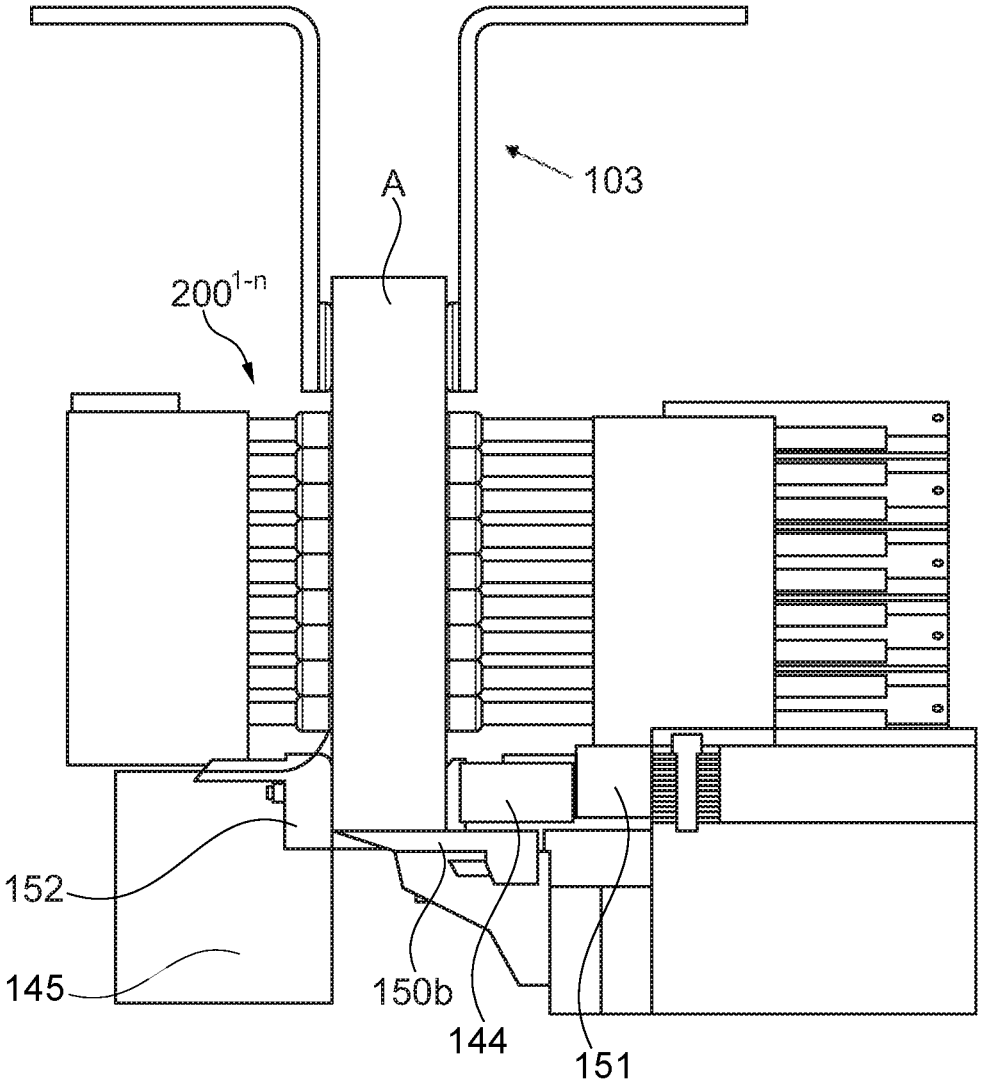
FIG. 10 is an additional illustration during the cutting operation.

Once the press bars $\mathbf{200}^{1\text{-}n}$ that are being used from the press bar group 200 have clamped the particular book block at the second cutting location 2 (see FIG. 1, reference numeral 2), as may be seen in FIG. 10, the first gripper 103 may release the book block and be moved back into its take-over position (cutting location 1, FIG. 1) for the next book block.

Furthermore, FIG. 10 shows the final force-related retention of the book block A during the cutting operation, for ensuring that the cut may be performed to a high quality by the blade 150*b* shown. Thus, when the press bars $\mathbf{200}^{1\text{-}n}$ being used (see FIGS. 8 and 9) have taken the book block A from the gripper 103, press beams (reference numeral 144) that exert the definitive pressing force on the book block in the direct cutting region come into action. In the process, this force has to be designed to be predominantly counter to the pressing force exerted by the press bars so that the cut carried out by the blade 150*b* allows for a rectangular, sharp cut edge. The press device consists of an immovable stop 152 as a component of a press plate 145 (see also FIG. 7) on one side of the book block, and of an opposite, movable press beam 144 on the other side, which is pressed against the book block by a clamping bolt 151.

In a further embodiment, the stop 152 may also be designed to be movable in order to take account of the thickness and/or thickness consistency of each book block let in from above—in other words, so that the leading edges of the inserted book block cannot push up. The stop 152 may be dynamically adjusted in this manner by the above-mentioned machine controller.

The clamping bolt 151 for the press beam 144 may, for example, be driven by a motor or hydraulically or pneumatically, and thus exert the pre-set pressing force on the book block.

The other press beams (see FIG. 7, reference numeral 144) at the other cutting locations 1, 3, which now provide the pressing force exertion in the vertical plane, also function following the same principle. The aim here too is to ensure a rectangular, sharp cut edge.

As soon as the book block is cleanly held by the press bars $\mathbf{200}^{1\text{-}n}$, the second cutting operation (front cut) may be carried out. Following the end of the cutting operation, a second gripper 104 (see FIG. 1) travels into the position above the press bar group and grips the book block in a similar manner to the first gripper 103. In the process, the position of the second gripper 104 in which it clamps the book block is dependent on the cut book block height. The controller brings the second gripper 104 into the pre-calculated gripping position, so that the correct book block height is produced by the third cutting operation (see FIG. 1, reference numeral 3) on the book block.

Once the second cutting operation (front cut) is complete, the press bar group 200 opens and the second gripper 104 moves the printed product further into the cutting position for the third trimming operation (foot part), by means of a vertical movement (from the cutting position), then a horizontal movement (supply to the next cutting position), and finally another vertical movement (see FIGS. 1 and 2).

During the vertical movements in the region of at least one cutting position, the particular loaded gripper performs another lateral offset movement, as required, with respect to a clamping surface of the clamping apparatus.

Figure 11:
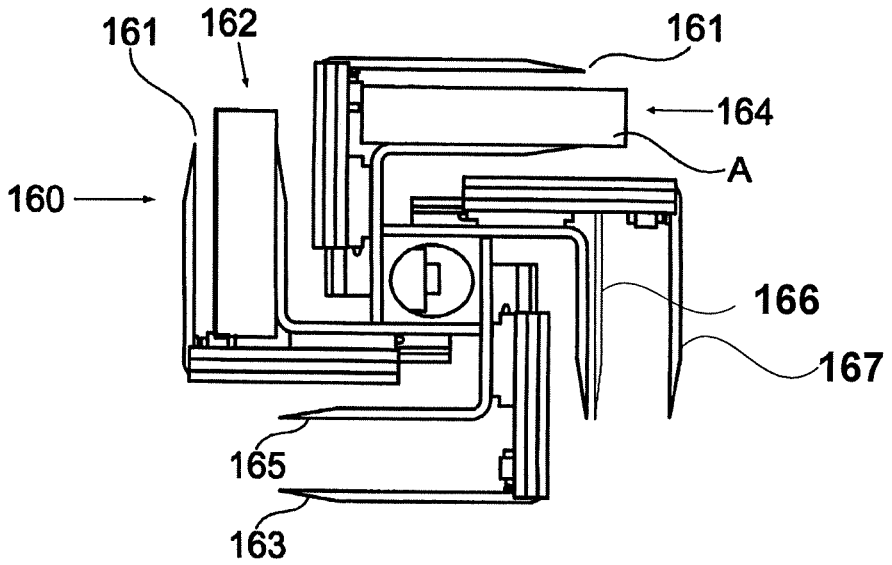
FIG. 11 shows a rotatable four-clamp system as a clamping apparatus and removal apparatus.

When the cutting operation at the third cutting location 3 (see FIG. 1) is complete, the rotatable removal apparatus (four-clamp system) 160 according to FIG. 11, and thus also the clamp 161, moves away from the blade together with the book block orthogonally to the blade movement. The rotatable four-clamp system 160 rotates by 90° during each cycle.

In this context, the four-clamp system 160 shown in FIG. 11 shows the position of the clamp 161 in the cutting position 162, in which a movable jaw 163 is still open. Another clamp operates within the removal position 164. In this position, the book block A may be removed. The mode of operation of the four-clamp system 160 ensures that, during the cutting process at the third cutting location 3 (see FIGS. 1 and 7) and the rotational movement of the four-clamp system, the book block A is pressed for a sustained period of time between the movable jaw 163 and the stationary jaw 165. Furthermore, two states of the clamp 161 may be seen within one quadrant, namely a completely closed position 166 and a completely open, intermediate position 167. One variant or another within the quadrant may be specifically considered, depending on the spatial conditions present respectively during the rotation.

A removal apparatus may, for example, be a conveyor belt that is equipped for conveying the book block by means of movable rollers. Other devices known from the prior art may also be provided.

Figure 12:
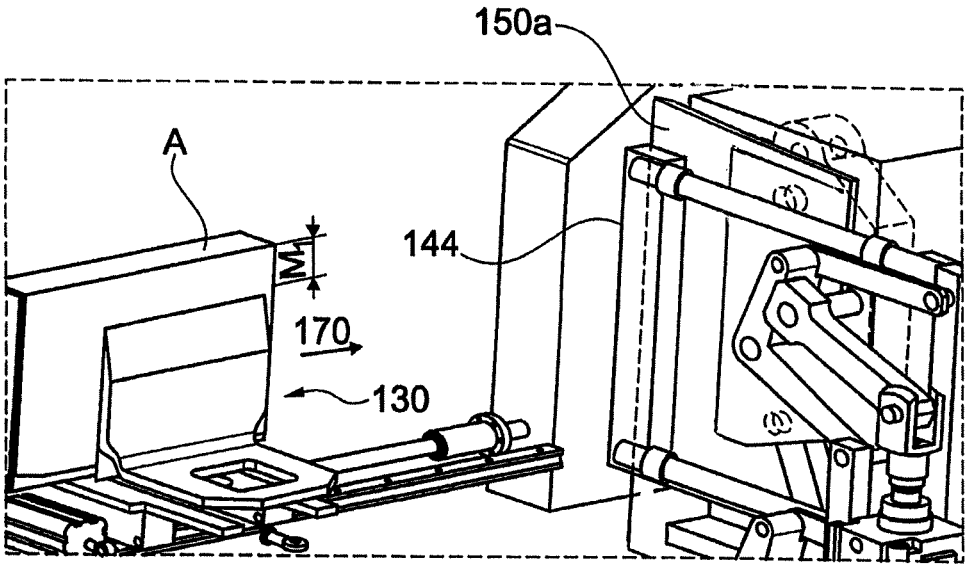
FIG. 12 shows the overall pressing of the book block during the cutting operation.

FIG. 12 shows the overall pressing of the book block by means of press beams 144 during the cutting operation. In terms of the action, pressing of this type corresponds to that described in relation to FIG. 10. The feed direction is shown by reference numeral 170.

Figure 13:
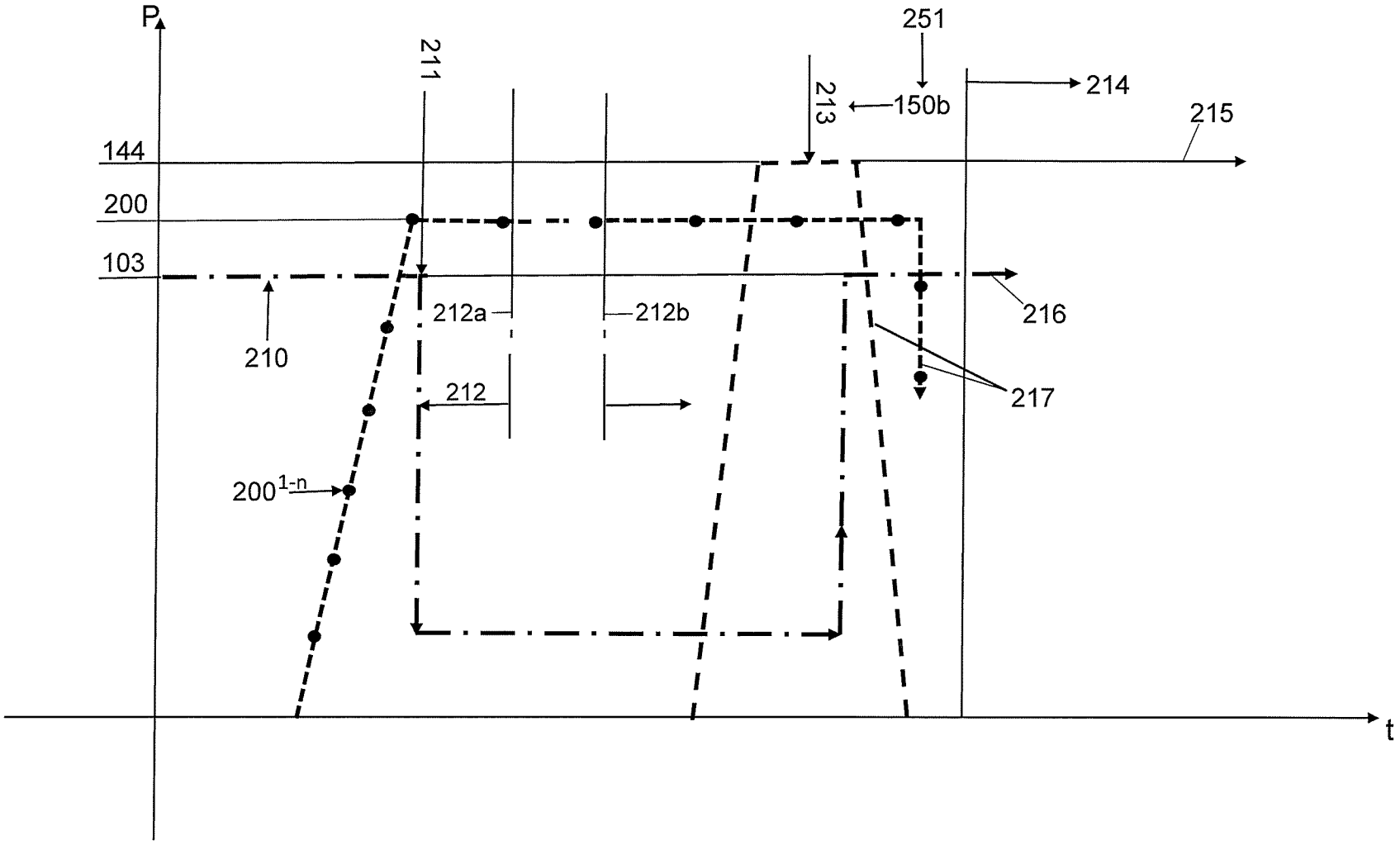
FIG. 13 shows the course of the force application of various clamping elements during a cutting operation.

FIG. 13 shows the interdependence of the various pressing elements (clamping apparatuses) on the printed product, which interdependence is applied, based on the cutting location 2, by the various clamping apparatuses 103, 200, 144, the one clamping apparatus 200 at this cutting location consisting of a press bar group 200. The clamping forces of the various clamping apparatuses in the graph should also only be understood in terms of quality. The clamping force of the gripper 103 that is provided for the transport 210 of the printed product from one cutting location to the next is in itself smaller than the cutting location-related clamping forces of the assemblies 200 and 144, since the force in this case is merely one that has to be sufficient for the secure clamping effect of the printed product during the transport. At the cutting location 2, the clamping force of the press bars $\mathbf{200}^{1-n}$ belonging to the press bar group then quickly rises simultaneously or one after the other, so that the pressing force of the gripper 103 drops 211 immediately (drop point) as soon as the final clamping force of the press bars on the printed product is achieved. The scope in which the pressing force of the gripper on the printed product drops is set in each individual case and also depends on the weight of the printed product in question. The final clamping force on the printed product, which is important for the qualitative cut quality, is then exerted by the above-mentioned press beam 144, which assumes its position fully in parallel with the plane of the cutting blade. As may be seen from the force graph according to FIG. 13, the press beam 144 preferably applies the largest clamping force, which takes place in a variable and phase-shifted 212 manner (intervention plane) with respect to the other clamping apparatuses, as shown by the parallel broken lines 212*a*, 212*b* (phase shift interval). As soon as the pressing force from the press beam 144 is applied, the blade carries out the cutting operation 213. Subsequently, the press beam 144 remains in the cutting plane 215 for a brief period until the pressing force of the gripper has risen to such an extent that reliable further transport 214 of the printed product is ensured. Afterwards, the clamping forces of the other elements 144, 200 decrease according to a particular reduction curve 217, such that the further transport plane 216 containing the printed product that is gripped completely by the gripper 103 is open again. In principle, this dynamics also applies to the gripper 104 belonging to the second support 102 (see FIG. 1) in operative connection with the respective clamping apparatuses.

FIG. 13 also shows symbolically that the mutually coordinated uniform, non-uniform or adaptive speed and/or movement profile of both clamping elements of a clamping apparatus may also be provided for one-sided exertion of pressing force by the press beam 144 in that the provision of force for the blade 150*b* is no longer coupled with that for the press beam 144, and instead the press beam exerts its pressing force autonomously on the printed product, as symbolized by the reference numeral 251 (see also FIG. 7). Consequently, the exertion of pressing force by the press beam on the printed product may be provided in accordance with specific criteria. The speed profile of the press beam 144 may be converted immediately after the first point of contact with the printed product into another mode. This is also true for the force application on the printed product, which may rise or fall successively in a monotonic or semi-monotonic manner depending on the requirements. Thus, if a certain flexion towards the end of the pressing is desired during the application of force by the press beam 144, for example so as to act gently on the spine part of the printed products, which if need be is slightly thickened, this may be provided with activation of a corresponding control profile, in accordance with which for example the monotonically rising force may transition into a curve in accordance with the principle of capacitor charging. Accordingly, it is then readily possible to provide an exponential force application, which is used intermediately or generally.

Document EP1647373 A1 also forms part of this description, in particular when it comes to demonstrating how the coordinates of the drives for providing the pressing force and blade dynamics might be provided.

Figure 14:
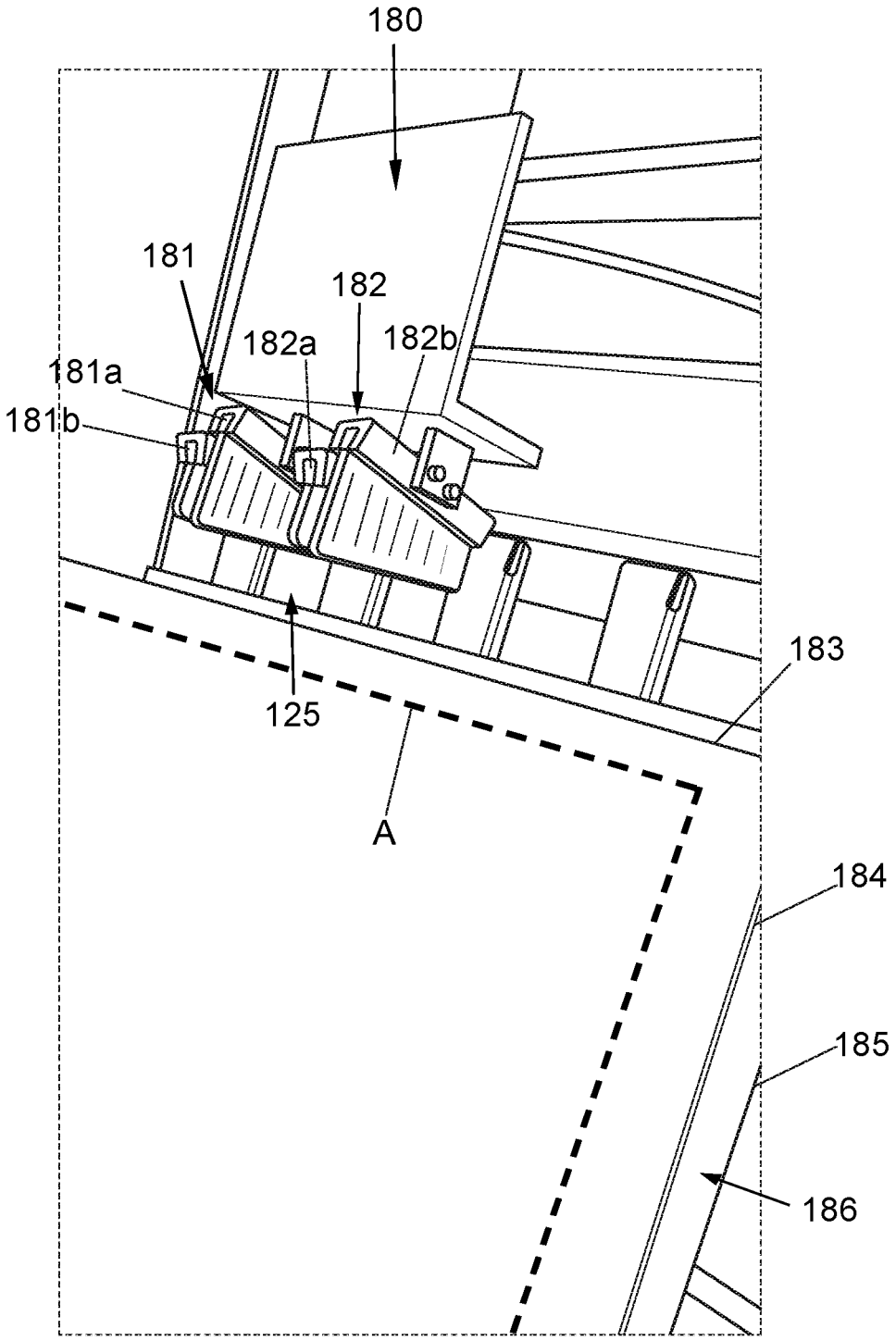
FIG. 14 shows a leveler slide for the vertical force exertion on the printed product.

FIG. 14 shows the configuration of a leveler slide 125 (see also FIG. 3). The slide consists of a receiving plate 180 which acts from above and carries brush bodies 181, 182 on the printed product side, which bodies exert a pressure on the front cover ends 183 that protrude beyond the printed product A, so that the spine of the printed product is in line with the bearing surface within the feed wheel 120. Since the cover ends 184 are located on the front in the same alignment plane, they may be better seen in positions 185 and 186 (head side or foot side of the printed product A). The two brush bodies 181 and 182 each consist of two sub-brush bodies 181*a*, 181*b*, 182*a*, 182*b*, which are at such an angle to one another that the particular cover end is gripped in a wedge-like manner and may accordingly be pressed downwards in parallel, whereby the cover ends do not undergo any damaging arching.

Figure 15:
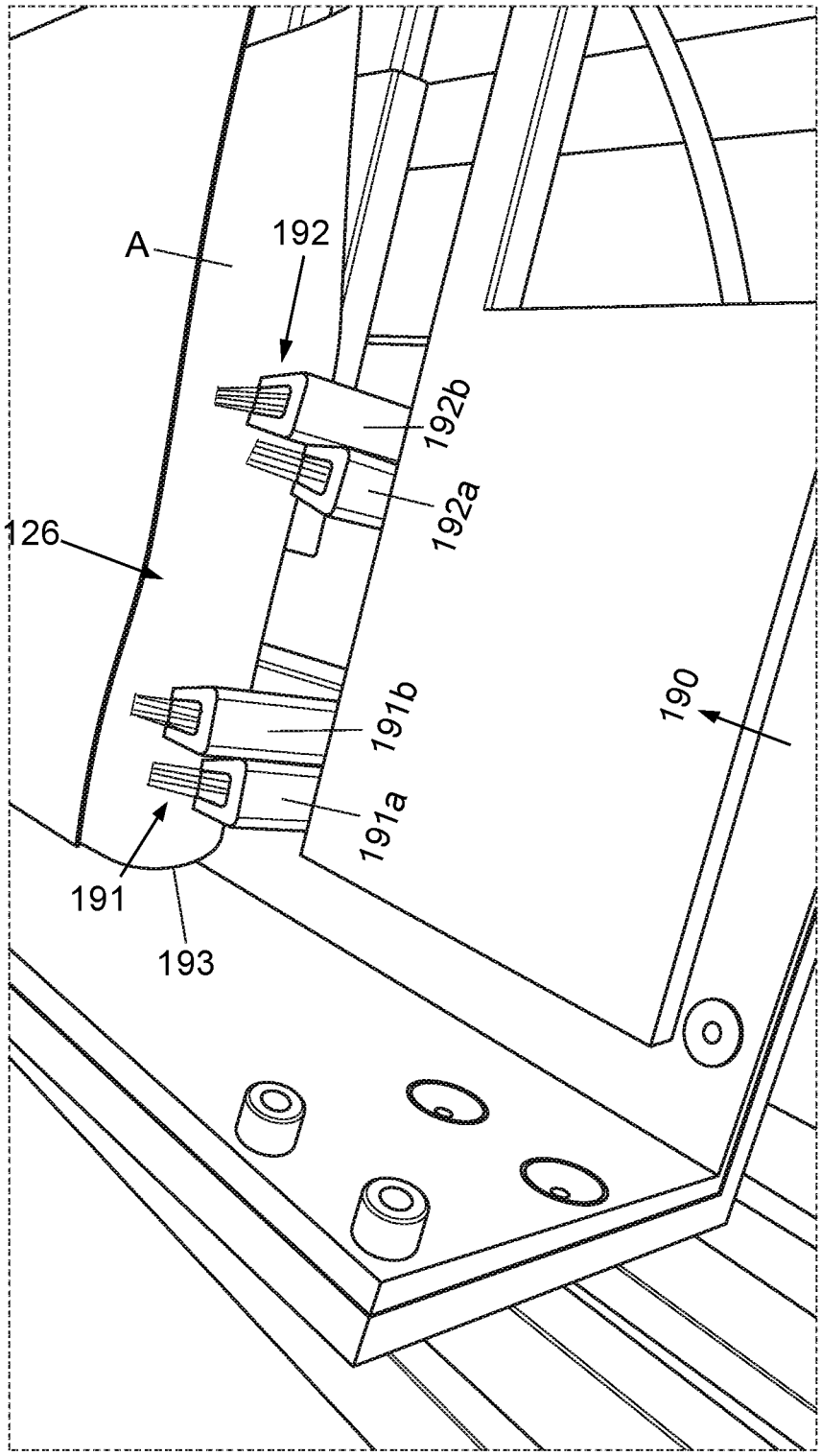
FIG. 15 shows a leveler slide for the horizontal force exertion on the printed product.

FIG. 15 shows the configuration of another leveler slide 126 (see also FIG. 3). The slide consists of a receiving plate 190 that acts from the side (head side or foot side) and carries brush bodies 191, 192 on the printed product side, which bodies exert a pressure on the head-side or foot-side cover ends 184, 185 that protrude beyond the printed product A, so that the printed product A is positioned accordingly for the cutting operations. In this case, the overhanging cover ends are visible in relation to the spine part 193 of the printed product A. The two brush bodies 191 and 192 each consist of two sub-brush bodies 191*a*, 191*b*, 192*a*, 192*b*, which are at such an angle to one another that the particular cover end is gripped in a wedge-like manner by the brush bodies and the entire printed-product body may be positioned according to requirements, whereby the cover ends do not undergo any damaging arching.

Figure 16:
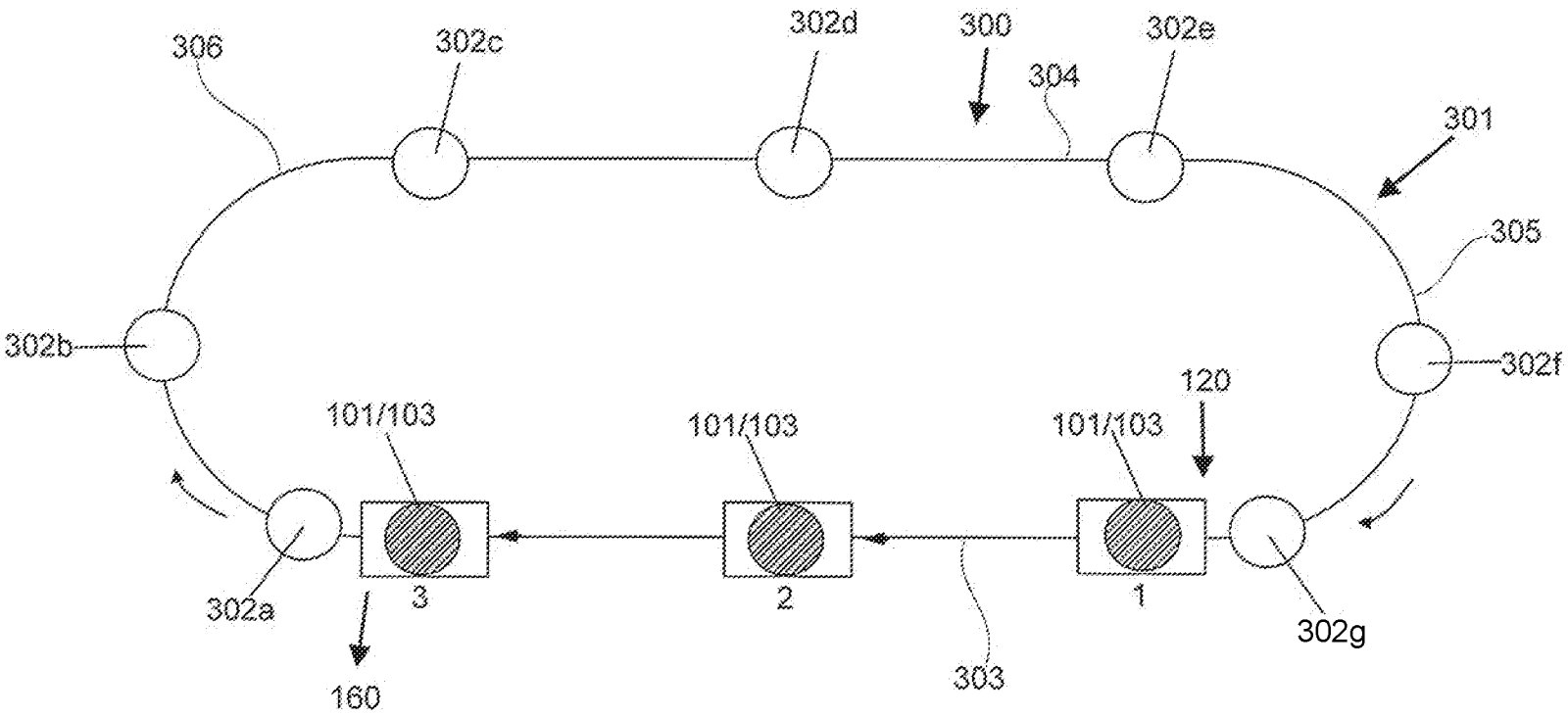
FIG. 16 shows a further transport device for the printed products.

FIG. 16 shows a further transport device 300 for transporting the printed products from one cutting location 1 to the next 2, and from there to a third 3. The cutting operations performed at these cutting locations are the same as those described for FIG. 1.

The main difference compared to the dynamics according to FIG. 1 lies here in that at least three supports with respective grippers 101/103 are in operation along a substantially ellipse-like path 301, wherein this functional endless path consists of a front section 303 and a rear section 304 running substantially in parallel, wherein the two sections transition into one another respectively by a lateral curvature 305, 306. The front section is used to guide the supports 101, which follow on from one another within the cycle, in a straight line or in a semi-straight line along the cutting locations 1, 2, 3. The number of supports 101 along the path is dependent on the maximum permissible cycle, i.e. each support takes a printed product in a spring-guided manner and guides it via the fundamental three cutting locations 1, 2, 3, without transfer to another support. In order to maximize production, the cycle is designed such that the supports follow one another closely, and the distance from one another is dependent on the time required for the individual cutting operations, whereby more than two, for example three supports are generally used. A reduction of the number of supports may be achieved for example if they experience an acceleration along the rear section 304 between the last cutting location 3 and the first cutting location 1.

With a provision of this kind, the intermediate deliveries and take-overs of the printed product specific to the cutting location may thus be implemented by supports moving back and forth (see FIG. 1). On the other hand, more circulating supports 302*a*-302*g* must generally be provided in order to keep production high, since the supports require time to travel over the rear section 304.

For improved understanding, the supports in operation have been shown in a hatched manner, whereas the other, unloaded supports, i.e. those downstream of the feeding apparatus 160 which are each on their way to the feeding apparatus 120 in order to pick up a new printed product, are shown unhatched.

A transport variant of this kind characterized by an ellipse-like path 301 may form a suitable basis for central trimming of the printed products, that is to say if the three cutting operations are performed at a single cutting location, that is to say if the printed product is taken, fed to the central cutting location, and then delivered by the same support. Analogously, a central trimming of this kind may be arranged advantageously within the second cutting location 2. These supports in use advantageously then do not travel back over the front section 303, but instead over the rear section 304 so as not to inhibit the production flow.

It is obvious that, in the case of a central cutting location for trimming all format edges of the printed product, provisions must be made so that the movement of the side blades and the associated press beam has to be performed in a phase-shifted manner relative to the movement of the front blade and the associated press beam so as to be able to prevent a collision of the blades.

Figure 17:
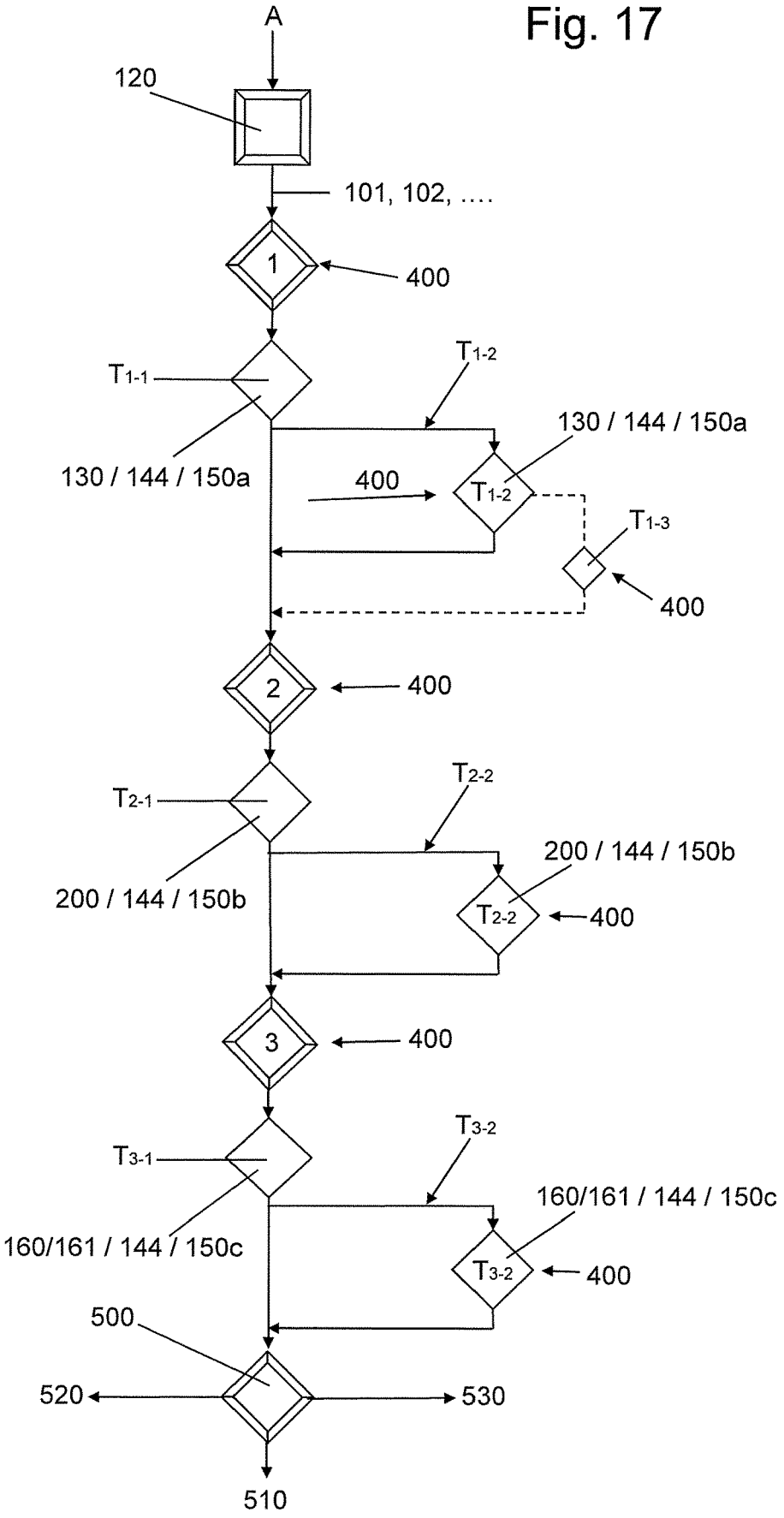
FIG. 17 is a diagram relating to the process sequences performed when making a second partial cut, subsequently to a first partial cut.

FIG. 17, in the form of a block diagram, shows the process sequences when carrying out a conventional single cut at each cutting location 1, 2, 3 and those sequences which require implementation of second, if need be further partial cuts to be performed subsequently. As already presented in part above, the introduced printed product A is oriented in the feed wheel 120 for the immediately imminent cutting operation, in such a way that the printed product A, for further transport, is gripped by its spine by the first support 101 of the transport unit once this first cutting operation has been performed, wherein the head edge of the printed product is fundamentally processed at the first cutting location 1, however it is not ruled out that this first cutting operation could be the foot cut. In principle, for this first cutting operation, the clamping apparatus 130 and the press beam 144 are activated, wherein the cutting blade 150*a* performs the cutting operation. With regard to the sequences occurring within this first cutting location 1, reference should be made to the description relating to the previous drawings.

A quality check 400 takes place already with this first cut and is focused on the quality of the cut made and on the other hand also includes an examination as to whether the thickness of the cut portion corresponds to the values defined in advance. At the same time, the integrity of the spine of the book block is also examined. The means used for these examinations on the one hand include contact-based and contactless sensors, which integrally detect the current state of the printed product after each cutting operation and forward their information to the controller, and on the other hand also intelligent sensors, which enable sensor-assisted production since they are capable of controlling and optimizing the focused quality processes. These sensors must have excellent data quality for the underlying quality examinations and are preferably constructed on the basis of inductive and photoelectric technology. Generally, the measurand will thus be converted by the physical measurement principle of the sensor element into an internal signal. As necessary, further individual electronic processes are provided, whereby a measured value is then available at the outlet in the form of an electrically and/or electronically usable signal.

If the controller has identified a second partial cut $T_{1-2}$ at this first cutting location 1, there is in principle a process-induced repetition of the first cut i.e. the necessary pressing of the printed product is performed by the same means 130 and 144, and the cutting operation is performed with the same cutting blade 150*a*. In addition, a coordinated kinematic procedure is also provided, which ensures that the portion of the head edge of the printed product A that is to be trimmed additionally may then be transported relative to the fixed cutting blade 150*a*.

Thus, once the partial cut has been made, this being the first partial cut according to definition, the printed product A is briefly securely clamped by the clamping jaws of the gripper 103 of the support 101 of the transport unit, whereupon the clamping jaws 131, 132 belonging to a clamping apparatus 130, also referred to as a transport clamp, open slightly, such that the printed product A is positioned relative to the said clamping jaws 131, 132 in a pressure-free manner. Intermediately, the clamping jaws belonging to the gripper 103 of the support 101 of the transport device exert a frictional-connection force on the printed product A at the location where the first partial cut was made, which clamping jaws, operatively connected to this support of the transport unit, provide the printed product A with an intertemporal local positioning when the clamping jaws 131, 132 of the transport clamp 130 are open. During this interval, the open clamping jaws 131, 132 of the transport clamps 130 move rearwardly relative to the cutting blade 150*a* by a certain length, wherein this length corresponds to the width of the second partial cut $T_{1-2}$. At the end of the travelled length, the clamping jaws 131, 132 of the transport plan 130 exert a frictional-connection force on the printed product A again with coordinated opening of the clamping jaws of the gripper 103 of the support 101 of the transport unit. These clamping jaws 131, 132 of the transport clamp 130 now displace the clamped printed product A forwards by the relevant length for the second partial cut $T_{1-2}$, in such a way that the printed product A is thus transferred again in the cutting position. Immediately before the second partial cut $T_{1-2}$ is started, the printed product A is pressed by a cutting location-related press beam 144, which exerts the ultimate pressing force on the printed product. Once the second partial cut $T_{1-2}$ is complete, the press beam 144 travels back in a manner synchronized with the cutting blade 150*a*, whereupon the clamping jaws 131, 132 of the transport clamp 130 open, and the printed product A is then conveyed further on by the support 101 of the transport device. Also during and following completion of this cutting operation, quality-checking sensors 400 remain in use concomitantly, until the sensors of the next cutting location perform the quality check, whereby it is ensured that the quality check may be maintained over all cutting operations.

Insofar as the controller might have identified a third partial cut $T_{1-3}$ after the second partial cut $T_{1-2}$, here as well there is in principle a process-induced repetition of the first partial cut $T_{1-1}$ or second partial cut $T_{1-2}$, and also with this third partial cut $T_{1-3}$ the above-described quality-checking sensors are activated once the third partial cut is complete.

According to FIG. 1, the first support 101 actively takes the printed product A once the first cutting operation at the first cutting location 1 is complete, or after the second, third, etc. cutting operations. Then, the first support 101 transfers this printed product A to the second cutting location 2, and returns to the starting position at the first cutting location 1 once the printed product A has been delivered in order to pick up another, subsequently delivered, trimmed printed product A, after the first cutting operation, and if need be further cutting operations, at the first cutting location 1 is/are complete.

With regard to the correct cutting operation at the second cutting location 2, reference is made to the above comments for FIGS. 8-10. Should a second partial cut or further partial cuts be performed at this second cutting location, these partial cuts are performed within this second cutting location 2 in accordance with the following method steps:

Once the first partial cut $T_{2-4}$ has been made, the printed product is securely clamped briefly by the gripper 103 of the support 101 of the transport unit, whereupon the press bars $\mathbf{200}^{1-n}$ belonging to a clamping apparatus at this second cutting location 2 open slightly, such that the printed product A is positioned relative to the press bars in a pressure-free manner. Intermediately, the gripper 103 belonging to the support 101 now exerts a frictional-connection force on the printed product A at the location of the previously made first partial cut $T_{2-1}$, which force provides the printed product with an intertemporal locally determined positioning when the press bars of the press bar group 200 are open. During this interval, the support 101 of the transport unit then moves the printed product downwards in a vertical direction by a certain length, wherein this displacement corresponds to the cut value for the second partial cut $T_{2-2}$. At the end of the travelled length, the press bars $\mathbf{200}^{1-n}$ of the press bar group 200 exert a frictional-connection force on the printed product A with synchronized opening of the gripper 103 of the support 101 of the transport unit. Immediately before the second partial cut is started, the printed product A is then pressed by the cutting location-related press beam 144.

In the meantime, the gripper 104 of the second support 102 of the transport device takes the printed product A immediately once the cutting operation at the second cutting location 2 is complete and transfers this printed product A to the third cutting location 3, where the third cutting operation takes place. The second support 102 of the transport device then returns to the second cutting location 2, where a further printed product A provided by the first support 101 of the transport device and already trimmed at the second cutting location 2 is ready to be taken and transferred to the third cutting location 3.

At this third cutting location 3, the foot edge of the printed product A is to be trimmed by one or more cuts. This is implemented in accordance with the following method steps:

Once the partial cut $T_{3-1}$, which by definition is the first partial cut, has been made at the third cutting location 3, the printed product A is briefly held by the gripper 104 of the second support 102 of the transport unit, whereupon the clamping jaws 163, 165 belonging to a clamping apparatus 160/161, as part of the four-clamp system or the feeding apparatus, open slightly, such that the printed product A is positioned relative to the said clamping jaws 163, 165 in a pressure-free manner. Intermediately, the clamping jaws belonging to the gripper 104 of the support 102 with the transport device exert a frictional-connection force on the printed product A at the location where the first partial cut $T_{3-1}$ was made, which clamping jaws, operatively connected to this support 102 with the transport unit, provide the printed product A with an intertemporal local positioning when the clamping jaws 163, 165 of the transport clamp 130 are open. During this interval, the open clamping jaws 163, 165 of the transport clamp 130 travel forwards relative to the cutting blade 150*c* by a certain length, wherein this length corresponds to the width of the second partial cut $T_{3-2}$. At the end of the travelled length, the clamping jaws 163, 165 of the clamping apparatus 160/161, with coordinated opening of the clamping jaws of the gripper 104 of the support 102 of the transport unit, exert a frictional-connection force on the printed product A again. These clamping jaws 163, 165 of the clamping apparatus 160/161 now displace the clamped printed product A rearwards in the direction of the cutting blade 150*c* by the relevant length for the second partial cut $T_{3-2}$, in such a way that the printed product A is thus transferred again in the cutting position. Immediately before the second partial cut $T_{3-2}$ is started, the printed product A is pressed by the cutting location-related press beam 144, which exerts the ultimate pressing force on the printed product. Once the second partial cut $T_{3-2}$ is complete, the press beam 144 travels back in a synchronized manner with the cutting blade 150*c*, whereupon the clamping jaws 163, 165 of the clamping apparatus 160/161 open, and the printed product A is then transferred via the feeding apparatus to an ejection apparatus 500. The quality-checking sensors 400 are also in use during and after this cutting operation.

A subsequent ejection apparatus 500, which performs a triaging of the cut printed products on the basis of the inputs originating from the quality-measuring sensors 400 thus acts in operative conjunction with this feeding apparatus. This ejection apparatus 500 (not shown in greater detail) is designed such that, on the one hand, the perfect printed products are "allowed through", whereas the printed products identified as defective are ejected, wherein here as well an alternative is incorporated, such that a further distinction is made between an ultimate ejection 520 and a conditional ejection 530. In the latter case, the preconditions that these printed products may be converted by way of a post-treatment into perfect printed products must be satisfied.

A variant of this ejection apparatus 500, which variant is not shown in greater detail, but is easily comprehensible to a person skilled in the art, may be implemented by way of a cross distributor. The printed products 510 considered to be "good" are transported on further in the conventional manner via longitudinal belts. These longitudinal belts include sets of rollers on their underside, which when activated, that is to say when a printed product is to be ejected, are raised upwardly above the running surface of the longitudinal belts and may thus channel the printed product differently. Provided "good" printed products 510 are being transported, the rollers remain inactive. Thus, if a loss of quality of the cut printed product is notified by the installed quality-measuring sensors 400, the ejection is activated in a product-specific manner. In such a case, the previously inactive rollers are engaged by being controlled for the relevant ejection in that a further separation is performed, specifically, whether the ejection of the printed products is a definitive ejection 520 or only a conditional ejection 530. In the case of conditionally ejected printed products, it is assumed that these products may still be saved. This ejection apparatus 500 is not limited to the described cross distributor.

The described three-blade trimmer 100 according to the invention has the following advantages over the known three-blade trimmer:

During cutting, the book block is pressed over almost its entire surface area by clamps or press bar groups. The book block only has a free surface $M_1$ in a region of the book spine. This is unimportant because the binding holds the book block together sufficiently in this region and the press bars support the book block in the cutting region within the particular cutting station of the cutting apparatuses. Pressing the book block over the entire surface area leads to a high cut quality.

The pressing over the entire surface area is achieved in a simple manner. There is no need to move any ribs, supporting elements or support bars according to the format. As a result, a high cycle count and thus high output of the three-blade trimmer may be achieved.

Since the book block is transported in a suspended manner to the individual cutting stations 141, 142, 143 (FIG. 7) by the three-blade trimmer according to the invention, there is no need to provide any support for the pages of the book block at the transfer points in the transport system. Since the book blocks are not transported horizontally, the pages of the book do not sag between the bearing points if the bearing surfaces are not over the entire surface area, as a result of which they cannot become caught at the transfer points.

The three cutting stations 141, 142, 143 of the cutting apparatus are arranged in a U-shape with the open side of the U arranged downwards with respect to one another. The trimming of the portion on the book block is carried out in all three cutting operations against the inside of the U-shape, in operative connection with the press beams 144 (see FIG. 7, and in particular FIG. 10). As a result, it is possible to successfully "convey away" all three trimmed-off portions using a single cut-off removal device arranged therebelow. In particular, the cut-offs fall downwards as a result of gravity without any auxiliary means.

Effective removal of cut-offs, regardless of whether the products are book blocks or booklets, is therefore very important because, in industrial production of individual books, the different formats are very often produced first at the three-blade trimmer. In the process, the book blocks are supplied to the three-blade trimmer at a size that is tailored towards the largest final format, which leads to large cut-offs in the case of small final formats.

In three-blade trimmers having cutting cartridges and press rams, it is common to orient the book block from the book spine towards the head side and from the book spine towards the foot side by means of two rectangular stops in the corners, and from the book block front side by one stop. In the production of books, booklets, etc. having variable formats, covers of the same format are mostly used for a particular format range. If the thickness of the book block now varies and the books are bound by binding machines having fixed-edge processing, the cover at the top side of the book does not protrude to the same extent as at the last page of the book.

If the book block height varies, the cover protrudes from the book to a greater or lesser extent depending on the circumstances. Generally, the book blocks are produced having a fixed projecting length of the cover on one side and a variable projecting length on the other side.

In products of this type, the orientation of the book block as provided for three-blade trimmers having cutting cartridges and press rams is unsuitable.

In the three-blade trimmer according to the invention, the uncut book block or the uncut booklets are oriented at the foot edge or head edge and the processed spine edge. The variable projecting lengths of the cover in the book block height and the book width are therefore insignificant.

For each book block to be cut or for each booklet to be cut, the three-blade trimmer controller has to know product data, from which the necessary movements of the transport members may be calculated, so that a cut book having the desired format dimensions is produced at the end.

In this case, these data may be transmitted to the controller in many different ways. A few options are set out below by way of example. Each book block or each booklet is equipped with an identification feature. A feature reader at the input of the three-blade trimmer reads the identification feature (e.g. 1-D or 2-D barcode, RFID chip, label, image, etc.) and transmits the information from the feature to the controller together with the machine cycle assignment. The feature may contain the necessary pieces of information that depict the cut printed product dimensions, or the missing information may be added from a database.

In another system, the book blocks are supplied to the three-blade trimmer in a clocked manner. With each cycle, the three-blade trimmer controller is supplied with the information that is required for cutting the book block to the correct dimension. In this case too, data supplied with the book block may be completed by data from a database.

Another option is that the data containing an order of the book blocks is communicated to the three-blade trimmer before the book blocks are supplied. With each book block that is supplied, the three-blade trimmer processes the next dataset in the predefined order. In the process, the book blocks have to be supplied in the correct order. For monitoring purposes, a feature reader that monitors the order may also be used.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A device for carrying out cutting operations on at least one open format edge of at least one printed product, the device being operatively connected to a printed product-related feeding apparatus for position-related orientation of the printed product at a first cutting location of a plurality of cutting locations and the device being operatively connected with a printed product-related removal apparatus at a third cutting location of the cutting locations, the device comprising:

a transport unit, wherein the transport unit is configured to controllably transfer the printed product along a guide path from the first cutting location to a second cutting location, of the cutting locations, and from the second cutting location to the third cutting location, wherein the transport unit comprises at least one gripper configured to grip the printed product by a spine of the printed product to convey the printed product along the guide path;

a cutting tool at one of the cutting locations, the cutting tool configured to controllably perform at least one of the cutting operations on a first edge of the at least one open format edge of the printed product; and a controller operably coupled to the transport unit and the cutting tool, the controller being configured to:

operate the cutting tool to perform a first edge-related cutting operation on the first edge of printed product;

determine whether to perform at least one subsequent edge-related cutting operation on the first edge of the printed product based on a quality of a first cut made by the first edge-related cutting operation on the first edge, and operate the cutting tool to perform the at least one subsequent edge-related cutting operation on the first edge of the printed product based on determining to perform the at least one subsequent edge-related cutting operation on the printed product.

2. The device according to claim 1, wherein the at least one subsequent edge-related cutting operation comprises a second edge-related cutting operation, wherein the controller is configured to operate the cutting tool to perform the second edge-related cutting operation directly after the first edge-related cutting operation, wherein the cutting tool is operating in a fixed location, and wherein, prior to the second edge-related cutting operation, the controller is configured to operate the transport unit to displace the printed product, relative to the cutting tool, by a length corresponding to an edge width to be cut in the second edge-related cutting operation.

3. A method for operating the device according to claim 2, wherein at least the second edge-related cutting operation, making a second subsequent partial cut at a head edge of the printed product, the head edge being the first edge, is performed at the first cutting location as follows:

a) once the first edge-related cutting operation is performed, making a first partial cut, the printed product is securely clamped briefly by the at least one gripper, of a first support of the transport unit, whereupon clamping jaws of a transport clamp open slightly, such that the printed product is positioned relative to the clamping jaws of the transport clamp in a pressure-free manner;

b) clamping jaws of the at least one gripper of the first support of the transport unit now intermediately exert a frictional-connection force on the printed product at the location of the first partial cut, and the clamping jaws of the at least one gripper of the first support of the transport unit provide the printed product with an intertemporal local positioning when the clamping jaws of the transport clamp are open;

c) during this interval, the open clamping jaws of the transport clamp move backwards away from the cutting tool by a length corresponding to a width of the second partial cut;

d) at the end of the travelled length, the clamping jaws of the transport clamp exert a frictional-connection force on the printed product again with coordinated opening of the clamping jaws of the gripper of the first support of the transport unit;

e) the clamping jaws of the transport clamp now displace the clamped printed product forwards in the direction of the cutting tool by the corresponding length for the second partial cut, in such a way that the format edge of the printed product to be trimmed is guided again in the cutting position;

f) immediately before the second partial cut is started, the printed product is pressed by a cutting location-related, beam-shaped press assembly;

g) once the second partial cut is complete, the press assembly travels back in a manner synchronized with the cutting tool, whereupon the clamping jaws of the transport clamp open, and the printed product then is conveyed further on by the first support of the transport device.

4. A method for operating the device according to claim 2, wherein at least the second edge-related cutting operation, making a second subsequent partial cut at the foot edge of the printed product, the foot edge being the first edge, is performed at the third cutting location as follows:

a) once the first edge-related cutting operation is performed, making a first partial cut, the printed product is securely clamped briefly by the at least one gripper of a second support of the transport unit, whereupon clamping jaws belonging to a clamping apparatus open slightly, such that the printed product is positioned between the clamping jaws of the clamping apparatus in a pressure-free manner;

b) the clamping jaws belonging to the gripper of the second support of the transport unit now, intermediately, exert a frictional-connection force on the printed product at the location of the first partial cut made, and the clamping jaws of the gripper of the second support of the transport unit provide the printed product with an intertemporal local positioning when the clamping jaws of the clamping apparatus are open;

c) during this interval, the open clamping jaws of the clamping apparatus move forward away from the cutting tool by a length corresponding to a width of the second partial cut;

d) at the end of the travelled length, the clamping jaws of the clamping apparatus exert a frictional-connection force on the printed product again with coordinated opening of the clamping jaws of the gripper of the second support of the transport unit;

e) the clamping jaws of the clamping apparatus displace the clamped printed product rearwardly in the direction of the cutting tool by a corresponding length for the second partial cut, in such a way that the format edge of the printed product to be trimmed is guided again in the cutting position;

f) immediately before the second partial cut is started, the printed product is pressed by a cutting location-related, beam-shaped press assembly;

g) once the second partial cut is complete, the press assembly travels back in a manner synchronized with the cutting tool, whereupon the clamping jaws of the clamping apparatus open, and the printed product is then operatively connected to a discharge apparatus and an adjoining ejection apparatus.

5. A method for operating the device according to claim 2, wherein the second edge-related cutting operation is performed, making a second subsequent partial cut at a front part of the printed product, the front part comprising the first edge, is performed at the second cutting location as follows:

a) once the first edge-related cutting operation is performed, making a first partial cut, the printed product is securely clamped briefly by the at least one gripper of a support of the transport unit, whereupon clamping assemblies belonging to a clamping apparatus open slightly, such that the printed product is positioned between these clamping assemblies in a pressure-free manner;

b) the gripper belonging to the support now, intermediately, exerts a frictional-connection force on the printed product at the location of the first partial cut made previously, which provides the printed product with an intertemporal local positioning when the clamping assemblies of the clamping apparatus are open;

c) during this interval, the support of the transport unit moves the printed product in a vertical plane downwardly by a length, wherein this vertical displacement corresponds to a length of the second partial cut;

d) at the end of the travelled length, the clamping assemblies of the clamping apparatus exert a frictional-connection force on the printed product again with synchronized opening operatively connected to the at least one gripper of the support of the transport unit;

e) immediately before the second partial cut is started, the printed product is pressed by a cutting location-related, beam-shaped press assembly;

f) once the second partial cut is complete, the press assembly travels back in a manner synchronized with the cutting tool, the clamping assemblies, comprising clamping jaws or pressing bars, of the clamping apparatus open, and the printed product is then conveyed further on by a further support of the transport device to the third cutting location.

6. The device according to claim 1, wherein the at least one subsequent edge-related cutting operation comprises a second edge-related cutting operation, wherein the controller is configured to operate the cutting tool to perform the second edge-related cutting operation immediately following the first edge-related cutting operation, the at least one subsequent edge-related cutting operation comprising the second edge-related cutting operation, wherein the controller is configured to operate the transport unit to stop and securely clamp the printed product at the corresponding one of the cutting locations based on an examination of an integrity of the spine, wherein, prior to the second edge-related cutting operation, the controller is configured to displace, relative to the printed product, the cutting tool and a press assembly by a length corresponding to a width to be cut based on a head, front, or foot edge-portion of the printed product, wherein the quality is based upon whether a thickness of a cut portion corresponds to a predefined value.

7. A method for operating the device according to claim 6, the method comprising:

once the first edge-related cutting operation is performed, which causes a first partial cut to be made, stopping the printed product, and clamping the printed product at the corresponding one of the cutting locations;

performing, by the cutting tool and the press assembly, interdependently of one another, once the first partial cut is complete at the head or the foot edge-portion of the printed product, at least one of a lateral or a vertical coordinated displacement corresponding to the length of cutoff the edge width to be cut in the second edge-related cutting operation, which causes a further partial cut to be made; and transporting, by corresponding supports of the transport unit, the printed product to a next one of the cutting locations.

8. The device according to claim 1, wherein the device is configured to carry out the cutting operations on the printed product that comprises a cohesive book block, individual booklets, or a number of stacked booklets.

9. The device according to claim 1, wherein the device is configured to carry out the cutting operations on a plurality of printed products, the printed products comprising the at least one printed product, the printed products before or after the cutting operations having the same or variable format dimensions with the same or different thickness dimensions.

10. The device according to claim 1, the device comprising three cutting tools, one of the three cutting tools being the cutting tool at one of the cutting locations, each of the three cutting tools configured to controllably, respectively perform one of the cutting operations to respectively trim the first edge, the second edge, or the third edge of the printed product at a respective one of the first cutting location, the second cutting location, or the third cutting location, the at least one open format edge of the printed product comprising the first edge, the second edge, or the third edge, wherein, collectively, the three cutting tools are configured to:

trim the first edge, corresponding to a head part of the printed product, at the first cutting location, trim the second edge, corresponding to a front part of the printed product, at the second cutting location, and trim the third edge, corresponding to a foot part of the printed product, at the third cutting location, or trim the first edge, corresponding to the foot part, at the first cutting location, trim the second edge, corresponding to the front part, at the second cutting location, and trim the third edge, corresponding to the head part, at the third cutting location.

11. The device according to claim 1, wherein the feeding apparatus is configured to provide position-based orientation of the printed product in respect of the optimal cutting position with regard to the at least one subsequent edge-related cutting operation.

12. The device according to claim 11, wherein the feeding apparatus, for the positional orientation of the printed product, formed as a book block, comprises a multi-part feed wheel, which is configured to be operated in accordance with the following criteria:

a) during a first 90° rotation of the feed wheel, a hinged rake-like guide performs a pivotable movement relative to the book block, in such a way that, following the 90° rotation, the book block rests on the spine and is thus protected against fanning out or tipping over;

b) the rake-like guide is coupled to a clamping assembly, which briefly clamps the book block resting on the spine, wherein this clamping assembly operates kinematically such that the rake-like guide is transferred into a position dependent on the book block thickness;

c) the clamping assembly then opens again slightly, such that the book block spine orients itself, as a result of gravity, against a stop surface within the feed wheel;

d) the clamping assembly then closes again, after which the book block has a defined position;

e) the feed wheel then rotates further by two 90° cycles respectively, whereby the book block is transferred relative to the cutting locations into a now suspended position;

f) during this aforementioned rotational movement, the first rake-like guide and an operatively connected second guide are pivoted away from the book block, wherein the book block is held in the region of at least part of its spine by the clamping assembly, in such a way that the part of the book block free from the guides hangs vertically downwards as a result of gravity alone.

13. The device according to claim 11, wherein the feeding apparatus for the printed product comprising at least one booklet has the form of a multi-part feed wheel which is configured to be operated in accordance with the following criteria:

a) during a first 90° rotation of the feed wheel, a hinged rake-like guide performs a pivotable movement relative to the booklet, in such a way that, following the 90° rotation, the booklet rests on the spine and is thus protected against fanning out and/or tipping over;

b) the rake-like guide is coupled to a clamping assembly, which briefly clamps the booklet resting on the spine, wherein this clamping assembly is operated kinematically such that the rake-like guide is transferred into a position dependent on the booklet thickness;

c) the clamping assembly then opens again slightly, such that the booklet spine orients itself, as a result of gravity, against a stop surface within the feed wheel;

d) the clamping assembly then closes again, after which the booklet has a defined position;

e) the feed wheel then rotates further by two 90° cycles respectively, whereby the booklet is transferable relative to the cutting locations into a now suspended position;

f) during this aforementioned rotational movement, the first rake-like guide and an operatively connected second guide are pivoted away from the booklet, wherein the booklet is held in the region of at least part of its spine by the clamping assembly, in such a way that the part of the booklet free from the guides hangs vertically downwards as a result of gravity alone.

14. The device according to claim 12, the device further comprising a pressing assembly that is configured such that when the clamping assembly is open, the pressing assembly is driven from above or from the side to provide a brief pressing force directly or indirectly on book blocks or booklets, and to ensure an end position of book blocks or booklets relative to the stop surface or a position predefined in at least in the horizontal direction.

15. The device according to claim 13, the device further comprising a pressing assembly that is configured such that when the clamping assembly is open, the pressing assembly is driven from above or from a side to provide a brief pressing force directly or indirectly on book blocks or the booklets, and to ensure an end position of the book blocks or the booklets relative to the stop surface or a position predefined at least in the horizontal direction.

16. The device according to claim 1, wherein the feeding apparatus in a region of the first cutting location is operatively connected to a movable clamping apparatus, which is equipped with clamping jaws and which is configured to transfer the printed product from the feeding apparatus whereupon the printed product is transportable to the first cutting operation.

17. The device according to claim 1, wherein the transport unit comprises at least a first support with a first gripper of the at least one gripper, wherein the first gripper is configured to grip the spine of the printed product to be trimmed, and wherein the first gripper forms the basis of the following controller-assisted translational movements along the guide path with respect to the cutting locations:

a) taking the printed product by the first gripper belonging to the first support following the end of the first cutting operation at the first cutting location;

b) transferring the printed product by the first support and the first gripper to the second cutting location, and, following the cutting operation at the second cutting location, c) transferring the printed product by the first support and the first gripper to the third cutting location for the third cutting operation, and thereafter d) returning the first support and the first gripper to the starting position at the first cutting location to take a subsequently delivered printed product again once the first cutting operation at the first cutting location has finished.

18. The device according to claim 1, wherein the transport unit comprises a plurality of grippers comprising the at least one gripper, wherein the transport unit consists substantially of two printed product-related supports which each have a respective one of the grippers, the grippers being configured to grip the spine of the printed product to be trimmed, the two supports and the grippers being operatively connected to one another, and the two supports and the grippers being configured to be operated relative to the cutting locations by the following controller-assisted translational movements along the guide path:

a) a first gripper, of the grippers, of the first support takes the printed product once the first cutting operation is complete at the first cutting location;

b) a first support, of the supports, then travels with the printed product to the second cutting location, where it positions the printed product for the second cutting operation to be carried out, and then travels back empty to the first cutting location, where a subsequently delivered printed product, present at this cutting location in an already trimmed state, is taken again;

c) in the meantime, a second support, of the supports, and a second gripper, of the grippers, takes the printed product immediately once the cutting operation at the second cutting location is complete, and transfers it to the third cutting location, where the third cutting operation takes place;

d) afterwards, the second support and the second gripper return empty to the second cutting location, where a subsequently delivered, trimmed printed product is again present, whereupon the second support and the second gripper travels with this printed product to the third cutting location again, in which the third cutting operation takes place.

19. The device according to claim 1, wherein the transport unit comprises at least two or three supports, which are guided along a closed guide path, wherein each support, of the supports, in a region of the cutting locations is configured to be loaded individually with at least one printed product, comprising the printed product, for the corresponding cutting operation, wherein each support, of the supports, is configured such that, once leaving the third cutting location, it is guidable, unloaded over the rest of the course of the closed guide path, back to the first cutting location, where it takes a subsequently delivered printed product before or after the first cutting operation, wherein the respective one of the supports together with the respective taken printed product is guidable successively after a specific cycle to other of the cutting locations in order to carry out the imminent one of the cutting operations.

20. The device according to claim 19, wherein the closed guide path has substantially a shape of an ellipse, a semi-ellipse, or a shape of a round or semi-round course.

21. The device according to claim 19, wherein a number of supports circulating along the guide path is dependent on a cycle of the cutting operations or is dependent on a selected return speed of the supports between the third cutting location and first cutting location.

22. The device according to claim 1, wherein the at least one gripper comprises at an end, clamping jaws configured to act on the printed product, in that a selective lateral offset movement relative to a press surface of at least one local arranged clamping or press apparatus is configured to be carried out with the at least one gripper loaded with the printed product in the region of at least one of the cutting locations before or after the cutting operation.

23. The device according to claim 1, wherein clamping jaws of the at least one gripper are configured to grip the printed product symmetrically, semi-symmetrically, asymmetrically, or maximized at a center of gravity of the printed product or depending on a length of the edges to be trimmed off.

24. The device according to claim 1, the at least one gripper at one of the cutting locations is configured to perform a further positioning movement in at least one plane relative to a stationary press surface of a clamping apparatus before or after at least one the cutting operations.

25. The device according to claim 1, wherein the removal apparatus is configured to be active at the third cutting location and to be operated in accordance with the following criteria:

a) the removal apparatus is operated via a multi-part operating wheel;

b) the removal apparatus comprises a clamping apparatus, which comprises at least a first jaw and at least a second jaw, with the first jaw and the second jaw a clamping effect is exercisable on the printed product on the occasion of the cutting operation;

c) following the cutting operation, the multi-part wheel performs a partial rotation, which transfers the printed product into a position leading away.

26. The device according to claim 1, wherein the removal apparatus at the third cutting location is operatively connected to a downstream ejection apparatus, which ensures that the printed product sensed as being good is released for further transport, and in that the printed product identified as defective during the cutting operations, based on continuous quality measurements performed by sensors, is ejected definitively or conditionally.

27. The device according to claim 26, wherein the ejection apparatus is constructed in the manner of a cross distributor, in such a way that, in the case of printed products of compromised quality, installed rollers are activated and raise from a surface, formed by longitudinal belts, for conveying good printed products, and thus perform the further ejection of the printed products.

28. The device according to claim 1, the device comprising three cutting tools, one of the three cutting tools being the cutting tool at one of the cutting locations, each of the three cutting tools configured to controllably, respectively perform at least one of the cutting operations at a respective one of the first cutting location, the second cutting location, or the third cutting location, wherein each of the cutting tools at each of the cutting locations is operatively connected to a stationary or semi-stationary clamping or pressing apparatus, wherein the stationary or semi-stationary clamping or pressing apparatus at each of the cutting locations is configured to controllably exercise at least one pressing force on the printed product, wherein the stationary or semi-stationary clamping or pressing apparatus at each of the cutting locations comprises controllable single-action or multi-action press surfaces belonging to at least one clamping jaw, and wherein the controller is configured to control the stationary or semi-stationary clamping or pressing apparatus at each of the cutting locations to coordinate with a format size of the printed product or to adjust to the particular format size of the printed product during the course of operation.

29. The device according to claim 1, the device comprising controllable force-exerting and operatively connected clamping or pressing apparatuses at each of the cutting locations, the controllable force-exerting and operatively connected clamping or pressing apparatuses comprising first clamping or pressing apparatuses at the first cutting location and second clamping or pressing apparatuses at the second cutting location, wherein the controller is configured to:

operate the gripper to apply a transport clamping force on the printed product when transferring the printed product between the cutting locations, operate the first clamping apparatuses to apply a first clamping force on the printed product at the first cutting location, the first clamping force being larger than the transport clamping force, and operate the second clamping apparatuses to apply a second clamping force on the printed product at the second cutting location, the first clamping force being smaller than the second clamping force.

30. The device according to claim 29, wherein the second clamping or pressing apparatuses comprise a press assembly configured as a press beam, the press beam being configured to: controllably press directly against the printed product at the second cutting location, or is to provide a pressing force by coordinated application of a mechanical, pneumatic, or hydraulic counterforce.

31. The device according to claim 28, wherein the stationary or semi-stationary clamping or pressing apparatus at each cutting location: comprises a press beam, is configured to produce the pressing force on the press beam, and is operatively connected to a drive for cutting-compliant pressing of the printed product, and wherein the drive at each cutting location is configured to controllably introduce a blade cutting force of the respective one of the cutting devices based on the respective pressing force.

32. The device according to claim 28, wherein the stationary or semi-stationary clamping or pressing apparatus at each cutting location: comprises a press beam, and comprises an autonomous drive that is configured to produce the pressing force on the press beam for cutting-compliant pressing of the printed product, and wherein each of the cutting tools comprises a drive for introducing a blade cutting force at the respective one of the cutting locations, the drive being detached from the autonomous drive at the respective one of the cutting locations.

33. The device according to claim 28, wherein the stationary or semi-stationary clamping or pressing apparatus at each cutting location: comprises a press beam, and is configured to controllably provide the pressing force with the press beam, the control of which being decoupled from a blade cutting force exertion by the respective one of the cutting tools.

34. The device according to claim 30, wherein the controller is configured to control the stationary or semi-stationary clamping or pressing apparatus at the respective cutting locations to adjustably exert the pressing force of the press beam based on: a thickness measurement, a format size, a cover consistency, or paper characteristics of the printed product, the pressing force being continuously determined or retrieved, by the controller, via stored control profiles.

35. The device according to claim 28, wherein the stationary or semi-stationary clamping or pressing apparatus at each of the cutting locations: comprises a press beam, and is configured to operate the press beam at least during the operative phase to exercise the pressing force, which is cutting compliant, on the printed product.

36. The device according to claim 28, wherein the stationary or semi-stationary clamping jaws are movable relative to one another in accordance with the following criteria:

a) each of the clamping jaws is operatively connected to a respective one of a plurality of drives, which are configured to operate to provide a clamping effect, wherein the drives are configured to controllably operate the clamping jaws based on adjustable or predictively controlled stroke and frictional engagement profiles;

b) the frictional movement profile performed by the clamping jaws is configured such that the printed product is detectable in a symmetrical or semi-symmetrical way relative to the thickness-related center line of the printed product;

c) a clamping force is exercisable on the printed product by means of the clamping jaws at least during the operative phase by a mutually coordinated uniform, non-uniform or adaptive speed and/or movement profile.

37. The device according to claim 1, wherein the transport unit comprises a gripper comprising clamping jaws, the clamping jaws being configured to controllably exercise a transporting pressing force for holding the printed product during transfer between the cutting locations, wherein the device comprises a first clamping apparatus at each of the cutting locations, the respective first clamping apparatus being configured to controllably exercise a first pressing force on the printed product for holding the printed product in a stationary manner at the respective one of the cutting locations, and wherein the device comprises a pressing-type clamping apparatus at each of the cutting locations, the respective pressing-type clamping apparatus being configured to controllably exercise a second pressing force directly in a region of the particular one of the cutting locations.

38. The device according to claim 37, wherein the first clamping apparatus that is operable at the first cutting location is a first clamping apparatus, the first clamping apparatus that is operable at the second cutting location is a second first clamping apparatus, the first clamping apparatus that is operable at the third cutting location is a third first clamping apparatus, and wherein the device comprises a second clamping apparatus that is respectively is operable at each of the cutting locations.

39. The device according to claim 38, wherein the second first clamping apparatus comprises individual successive press bars, the press bars being fixedly positioned on one side of the printed product, and the second first clamping apparatus is configured to controllably perform a frictional pressing movement with the press bars on the other side of the printed product.

40. The device according to claim 38, wherein the second first clamping apparatus comprises individual successive press bars, and wherein the second first clamping apparatus is configured to controllably perform an at least partially uniform directed frictional pressing movement directly or indirectly on the printed product by the press bars on both sides of the printed product.

41. The device according to claim 38, wherein the second first clamping apparatus comprises individual vertically or semi-vertically successive press bars, the second first clamping apparatus is configured to controllably perform frictional pressing movements with the press bars arranged on either side of the printed product, the movements of the press bars being symmetrical or semi-symmetrical with respect to a thickness-related center line of the printed product.

42. The device according to claim 38, wherein the first clamping apparatus at at least one of the cutting locations comprises successive press bars, the first clamping apparatus being configured to controllably operate the press bars during a subsequent pressing movement of the press bars against the printed product, which is after a first pressing movement of the press bars against the printed product, by starting with a first one of the press bars in a region of a spine of the printed product and then continuing to sue other ones of the press bars continuously until approximately in a plane of a respective edge to be cut.

43. The device according to claim 42, wherein the first clamping apparatus is configured to perform the subsequent pressing movement to control the press bars starting from the spine of the printed product to the edge to be cut to continuously compress out air captured between signatures of the printed product.

44. The device according to claim 1, the device comprising a plurality of cutting tools, comprising the cutting tool, at each of the cutting locations, and the device configured to carry out the cutting operations on the printed product that comprises a plurality of open format edges, comprising the open format edge, wherein a respective one of the cutting tools is capable of carrying out a cutting operation with regard to an individual one of the format edges of the printed product by an individually operating cutting operation at the respective one of the cutting locations.

45. The device according to claim 44, wherein at least one of the cutting tools comprises a single action cutting tool configured to carry out at least one of the cutting operations.

46. A method for ensuring the quality of trimmed printed products in a device according to claim 1, wherein, during the cutting operations in the cutting locations, an outer structure of the printed product and trimmed edges are examined continuously by quality-determining sensors, and wherein qualitative conclusions of the examinations are transmitted to an ejection apparatus, which performs a corresponding selection among the trimmed printed products in accordance with predefined quality criteria.

* * * * *